US005350904A

United States Patent [19]

Kemske et al.

[11] Patent Number: 5,350,904

[45] Date of Patent: Sep. 27, 1994

[54] SUSCEPTORS HAVING DISRUPTED REGIONS FOR DIFFERENTIAL HEATING IN A MICROWAVE OVEN

[75] Inventors: Jonathan D. Kemske, New Brighton; James R. Consaul, Plymouth; Diane R. Rosenwald, Shoreview; Robert B. Shomo, Jr., Circle Pines; Dan J. Wendt, Lino Lakes, all of Minn.

[73] Assignee: The Pillsbury Company, Minneapolis, Minn.

[21] Appl. No.: 874,107

[22] Filed: Jul. 20, 1992

Related U.S. Application Data

[63] Continuation of Ser. No. 798,357, Nov. 21, 1991, Pat. No. 5,220,143, which is a continuation of Ser. No. 197,634, May 23, 1988, abandoned.

[51] Int. Cl.[5] ..... H05B 6/80

[52] U.S. Cl. ..... 219/730; 219/759; 426/234; 426/107

[58] Field of Search ..... 219/10.55 E, 10.55 F, 219/730, 759; 426/107, 1089, 241, 234, 243; 99/DIG. 14

[56] References Cited

U.S. PATENT DOCUMENTS

| | | | |
|---|---|---|---|
| 3,079,913 | 3/1963 | Nelson | 126/390 |
| 3,219,460 | 11/1965 | Brown | 99/192 |
| 3,302,632 | 2/1967 | Fichtner | 126/390 |
| 3,394,007 | 7/1968 | Campbell | 99/1 |
| 3,547,661 | 12/1970 | Stevenson | 99/171 |
| 3,835,281 | 9/1974 | Mannix | 219/10.55 |
| 3,887,920 | 6/1975 | Wright et al. | 343/18 A |
| 3,941,967 | 3/1976 | Sumi et al. | 219/10.55 E |
| 4,190,757 | 2/1980 | Turpin et al. | 219/10.55 E |
| 4,230,924 | 10/1980 | Brastad et al. | 219/10.55 E |
| 4,258,086 | 3/1981 | Beall | 219/10.43 |
| 4,267,420 | 5/1981 | Brastad | 219/10.55 E |
| 4,306,133 | 12/1981 | Levinson | 219/10.55 E |
| 4,398,077 | 8/1983 | Freedman et al. | 219/10.55 F |
| 4,495,392 | 1/1985 | Derby | 219/10.55 E |
| 4,626,641 | 12/1986 | Brown | 219/10.55 E |
| 4,641,005 | 2/1987 | Seiferth | 219/10.55 E |
| 4,676,857 | 6/1987 | Scharr et al. | 156/233 |
| 4,703,148 | 10/1987 | Mikulski et al. | 219/10.55 W |
| 4,800,247 | 1/1989 | Schneider et al. | 219/10.55 E |
| 4,801,774 | 1/1989 | Hart | 219/10.55 E |
| 4,835,352 | 5/1989 | Sasaki et al. | 219/10.55 E |
| 4,865,921 | 9/1989 | Hollenberg et al. | 428/461 |
| 4,908,246 | 3/1990 | Fredricks et al. | 428/34.1 |
| 5,039,833 | 8/1991 | Woods | 219/730 |

FOREIGN PATENT DOCUMENTS

| | | | |
|---|---|---|---|
| 0205304 | 12/1986 | European Pat. Off. | B65D 81/34 |
| 0206811 | 12/1986 | European Pat. Off. | H05B 6/64 |
| 2382878 | 10/1978 | France | A47J 36/02 |

*Primary Examiner*—Philip H. Leung

*Attorney, Agent, or Firm*—Honigman Miller Schwartz and Cohn

[57] ABSTRACT

A packaging system is disclosed which includes a susceptor heating means having selective responsiveness to microwave radiation. The susceptor surface has a plurality of regions, where at least one region has an altered responsiveness to microwave radiation which is achieved by disruptions in the susceptor surface. A method for making regions of a susceptor selectively responsive to microwave heating by disrupting the continuity of the metallized film of the susceptor is also disclosed.

2 Claims, 15 Drawing Sheets

TEMP. PROFILE OF SCORED FISH SUSCEPTOR WITH FISH STICKS

EFFECT OF SCORED SUSCEPTOR ON CRISPNESS FISH STICKS

TEMP. PROFILE OF SCORED PIZZA SUSCEPTOR WITH TOPPED PIZZA

EFFECT OF SUSCEPTOR TYPE ON BROWNING PIZZA CRUST

MEAN IR TEMPERATURES
5"x5" SHEET (NOT CALIBRATED)

DECREASING GRID SIZE
(KNIFE CUTS)
0.625
0.3125
0.1563
0.0781
1.25
2.5
5
RS-1650
46
45
RS-60
44
RS-18
5/32"-5/64" RESULTS IN
A DETERMINED AREA ON
A SUSCEPTOR
TEMPERATURE (°C)
(DECREASING TEMP)
36
35
34
33
32
31
30
29
28
27
26
25
0.00
2.00
4.00
SIZE OF GRID SQUARES (INCHES)

CUT GRID VS POWER
NETWORK ANALYZER

RP
AP
TP
1.25
0.625
0.3125
0.1563
0.0781
2.5
5
POWER
0.9
0.8
0.7
0.6
0.5
0.4
0.3
0.2
0.1
0
SIZE OF GRID

DISTANCE VS. TEMPERATURE
SUSCEPTOR GRADIENT

TEMPERATURE (°C)
51
50
49
48
47
46
45
44
43
42
41
40
39
38
37
36
35
34
33
32
31
30
29
0
20
40
60
80
100
120
140
DISTANCE FROM LEFT END
FIRST REGION (53)
SECOND REGION (54)
THIRD REGION (55)
FOURTH REGION (56)

63
65
62
65
64
65
63

63

65
66
67
64
67
63
65

SUSCEPTORS HAVING DISRUPTED REGIONS FOR DIFFERENTIAL HEATING IN A MICROWAVE OVEN

This is a continuation of application Ser. No. 798,357, filed Nov. 21, 1991 U.S. Pat. No. 5,220,143; which was a continuation of application Ser. No. 197,634, filed May 23, 1988 now abandoned.

BACKGROUND OF THE INVENTION

In the past, difficulties have been experienced in various attempts to brown or crispen foods in a microwave oven. A microwave oven heats foods differently from a conventional oven. Generally speaking, food substances are heated in proportion to their tendency to absorb microwave radiation, which may result in considerably different heating patterns from those which exist in a conventional oven. Also, microwave radiation penetrates into most foods in a way which results in considerably different heating patterns from those which would otherwise wise be present in a conventional oven. In most cases, microwave energy will heat foods faster than in a conventional oven. For example, a food substance which might require 30 minutes to properly "cook" in a conventional oven, may take only 3 or 4 minutes to "cook" in a microwave oven. In a conventional oven, the oven atmosphere is heated to relatively high temperatures to transfer neat to the food surface resulting in the surface always being the hottest area in the food. In a microwave oven, the oven atmosphere is generally not heated; the food itself heats and transfers heat to the surrounding air resulting in the food surface being cooler than the interior. These differences significantly affect one's ability to brown or crispen a surface of a food in a microwave oven.

Many attempts have been made to brown or crispen the surface of a food in a microwave oven. One such attempt has involved the use of packaging components called susceptors. Suitable susceptors may contain microwave absorbing coatings which are deposited upon a microwave transparent support layer. These susceptors heat when exposed to microwave radiation. A susceptor may achieve temperatures high enough to brown or crispen the surface of a number of food products. The susceptor may be placed in close proximity to, or in direct contact with, the surface of the food product. A typical, commercially available susceptor contains a thin film of vacuum deposited aluminum on polyester which is then adhesively laminated to paper or board.

The use of susceptors, however, has resulted in additional problems. Available susceptors typically do not heat uniformly. As a result, such susceptors may not crispen or brown the food substance uniformly. For example, the outer region of a susceptor may become much hotter during microwave irradiation as compared to the center region of the susceptor. As a result, the outer portion of the food substance may tend to become brown or crisp, but the center portion will not do so without overcooking the outer portion. This is a particular problem in food substances which have large surface areas, for example, the baked crust of a large frozen pizza. When a susceptor pad is used, for example, to crispen several fish sticks arranged side by side on the susceptor, microwave heating may typically result in fish sticks on the ends of the susceptor which are crisp, but fish sticks in the center of the susceptor pad may not be adequately crisp.

An additional problem of heating foods using susceptors is the lack of control of the heating profile across the susceptor surface. It is often desirable to adjust the amount of heat output in sections of a susceptor to accommodate different food characteristics. This is a particular problem when two or more foods with varying browning/crisping requirements are placed in conjunction with a common susceptor. When heated, one food's contact surface may become overcooked while an adjacent food's contact surface may remain soggy.

When a food substance is cooked by microwave radiation, particular attention must be paid to the overall energy balance achieved during the heating proceeds. If an attempt is made to simply increase the strength of the microwave radiation or cooking time in an effort to brown or crispen a particular area of the surface of the food substance, this may result in overheating or overcooking of other surfaces and/or the interior of the food substance itself. In other words, if one seeks to achieve browning or crisping of the center area of a pizza crust by simply increasing the heating time or by increasing the strength of the microwave radiation, the likely result would be an overcooking of the outer surface of the pizza and/or an overcooking of the pizza toppings.

Heating foods in a microwave oven, particularly where susceptors are employed, usually involves a complex balancing of energy which is absorbed throughout the food substance. Although the use of susceptors has resulted in some improvement in the browning or crisping of food substances in a microwave oven, the need has existed for solving the problem of susceptors which do not heat uniformly. Some means for browning or crispening food products uniformly with a susceptor has been needed. The need has further existed for some means to achieve uniform browning and crispening without disturbing the complex energy balance necessary to properly heat all portions of the food substance. Also, the need has existed to differentially brown or crispen various types of food products.

Examples of attempts to achieve crispening of food products is shown in U.S. Pat. No. 4,267,420, issued to Brastad, and U.S. Pat. No. 4,230,924, issued to Brastad et al. Brastad attempted to produce flexible wrapping material which was wrapped completely around a fish stick to brown the surface of the fish stick. However, Brastad did not address the problem of nonuniform crispening of the food surface. Brastad did not disclose how to compensate for nonuniform heating caused by The flexible wrapping material.

Another example is U.S. Pat. No. 4,641,005, issued to Oscar E. Seiferth. A thin film susceptor is disclosed for heating foods. However, Seiferth did not address the problem of nonuniform heating of the susceptor surface. Seiferth did not disclose how to compensate for food loads or how to compensate for susceptor preferential edge heating.

it will be apparent from the above discussion that prior art attempts to achieve crispening of the surface of a food substance in a microwave oven have not been altogether satisfactory. The use of susceptors has often resulted in nonuniform crispening of the food surface and undesirable nonuniform heating patterns.

SUMMARY OF THE INVENTION

In accordance with the present invention, a system for heating a food substance in a microwave oven is provided which may be used to achieve more uniform heating of the surface of a food substance. The system includes susceptor means which comprises variable sized conductive areas. The size of the conductive areas is adjusted to compensate for undesirable nonuniform heating patterns which would otherwise exist.

The susceptor means is located in close proximity to, or in direct contact with, the surface of the food substance which is to be crispened or browned. The susceptor means generally comprises a sheet with a conductive coating, typically a metallized film, which absorbs microwave energy during exposure to microwave fields. The susceptor means therefore heats in response to microwave radiation. In accordance with the present invention, the conductive coating is divided into a plurality of regions having susceptor areas which may be of a different size in each region. The susceptor areas may be formed, for example, by scoring, cutting, etching, stamping, printing, or other methods to disrupt the conductive coating of the susceptor means. At least one region has its responsiveness to the heating effects of microwave radiation altered by the disruptions in the conductive coating.

Portions of the susceptor which would otherwise tend to overheat may be provided with small susceptor areas which are comparably less responsive to microwave radiation. Portions of the susceptor means which would otherwise tend to underheat are provided with larger susceptor areas which are comparably more responsive to microwave radiation. By adjusting the size of the susceptor areas within the limits of this invention, it is possible to compensate for nonuniform heating patterns which might otherwise exist on a susceptor. More uniform crispening and browning of a food substance may thereby be achieved. Alternatively, when a nonuniform crispening or browning pattern is desired, a susceptor means may be designed in accordance with the present invention to provide a specific desired heating pattern.

BRIEF DESCRIPTION OF THE DRAWINGS

For a fuller understanding of the present invention, reference should be had to the following detailed description taken in conjunction with the drawings, in which.

DETAILED DESCRIPTION OF A PREFERRED EMBODIMENT OF THE INVENTION

In order to crispen the surface of a food substance, a susceptor pad 10 may be used. The food substance which is to be crispened may be placed in close proximity to, or in direct contact with, the susceptor pad 10. The susceptor pad 10 may include a layer of metallized polyester, composed of a layer of polyester which has a thin film of metal such as aluminum deposited thereon. The layer of polyester serves as a support for the thin film of metal. The conductive layer of metal may be deposited on the polyester substrate by a process of vacuum vapor deposition. The metallized polyester layer is preferably adhesively bonded to a supporting face, such as paper.

For a disclosure of the details of a suitable composition for the susceptor pad 10, reference is made to application Ser. No. 070,293, filed Jul. 6, 1987, by Michael R. Perry et al., entitled "Package for Crisping the Surface of Food Products in a Microwave Oven", the entire disclosure of which is incorporated herein by reference. Further disclosure of a susceptor pad is contained in U.S. Pat. No. 4,641,005, issued to Oscar E. Seiferth, entitled "Food Receptacle for Microwave Cooking", the entire disclosure of which is incorporated herein by reference.

Figure 1:
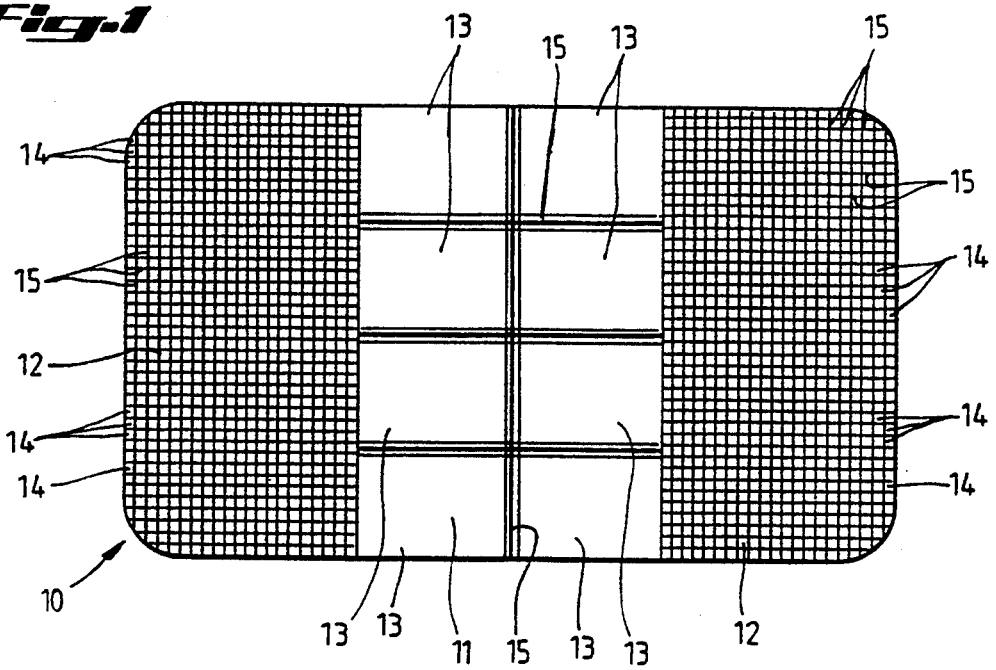
FIG. 1 is a cop view of a susceptor pad having two regions, each being provided with different sizes of susceptor areas formed thereon.
Figure 5:
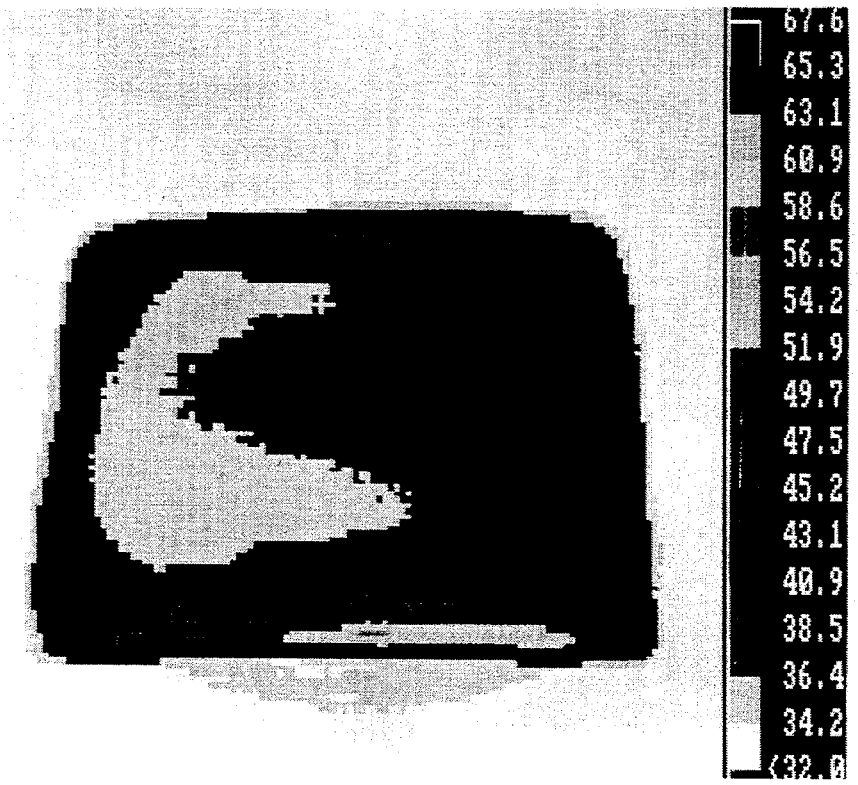
FIG. 5 is an image of a temperature pattern achieved during microwave irradiation of a susceptor that did not have variable sized susceptor areas in accordance with the present invention. The image was created by an infrared camera.

It has been found that if a susceptor pad having a continuous metallized layer is exposed to microwave radiation, an uneven heating pattern will typically result as shown in FIG. 5. The heating effects often will be most pronounced at the edges of the susceptor pad, while the center may not be adequately heated. When such a susceptor pad is used, for example, to crispen a plurality of fish sticks arranged side by side on the susceptor pad, microwave irradiation may typically result in fish sticks on the ends which are crisp, but fish sticks in the center of the susceptor pad may not be adequately crisp. At Least the fish sticks will not be uniformly crispened.

it is desirable to have some means to compensate for the nonuniform heating which may result when a susceptor pad is exposed to microwave radiation. In accordance with the present invention, variable sized susceptor areas are provided which compensate for the otherwise undesirable nonuniform heating characteristics of a susceptor pad. As illustrated in FIG. 1, susceptor pad 10 is provided with larger sized susceptor areas in center region 11 and relatively smaller sized susceptor areas in end regions 12. The relatively more microwave responsive center region 11 contains larger susceptor areas 13. The less microwave responsive end regions 12 contain relatively small susceptor areas 14.

In this illustrated example, the conductivity of the metallized film is broken by cuts or scores 15. The scores 15 may be cuts in the metallized layer made by a sharp implement such as a razor blade. Or the scores 15 may be formed by stamping a sharp die on the susceptor pad 10. Any means for forming disruptions or conductivity breaks between the metallized layer of one susceptor area 13 and an adjacent susceptor area 13 should provide satisfactory results. For example, conductivity breaks may be formed by etching, scoring, cutting, stamping, or photo resist methods. It has been surprisingly found that it is only necessary to disrupt the metallized layer, which can be sometimes done by drawing a line with a ball point pen across the surface of the susceptor pad 10. Generally, any procedure which disrupts electrical continuity in the thin film of metal has been found to be effective. The scores 15 similarly form conductivity breaks in the metallized film between a small susceptor area 14 and an adjacent small susceptor area 14.

The smaller susceptor areas 14 are formed sufficiently small so that the susceptor areas 14 are less responsive to microwave radiation than the larger susceptor areas 13. Thus, when the susceptor pad 10 is exposed to microwave radiation, the smaller susceptor areas 14 will be less responsive to the heating effects of the microwave radiation than would be the case if the scoring 15 was not provided on the susceptor pad 10. The smaller susceptor areas 14, in effect, "detune" the responsiveness of the end region 12 to microwave radiation.

The larger susceptor areas 13 are comparatively more responsive to heating effects of microwave radiation. The larger susceptor areas 13 are believed to have less of a "detuning" effect upon the center region 11. The larger susceptor areas 13 also improve the uniformity of heating of the center region 11. Without having the susceptor areas 13 cut in the center region 11, some edge heating of the center region 11 could occur in this example. The susceptor areas 13 may be formed so that no "detuning" effect is achieved. In some applications, it is only important that the relative heating of one region 12 be less than another region 11.

The configuration of the small susceptor areas 14 and the larger susceptor areas 13 illustrated in FIG. 1 tends to compensate for the tendency of the end regions 12 to overheat as compared with the center region 11.

Figure 2:
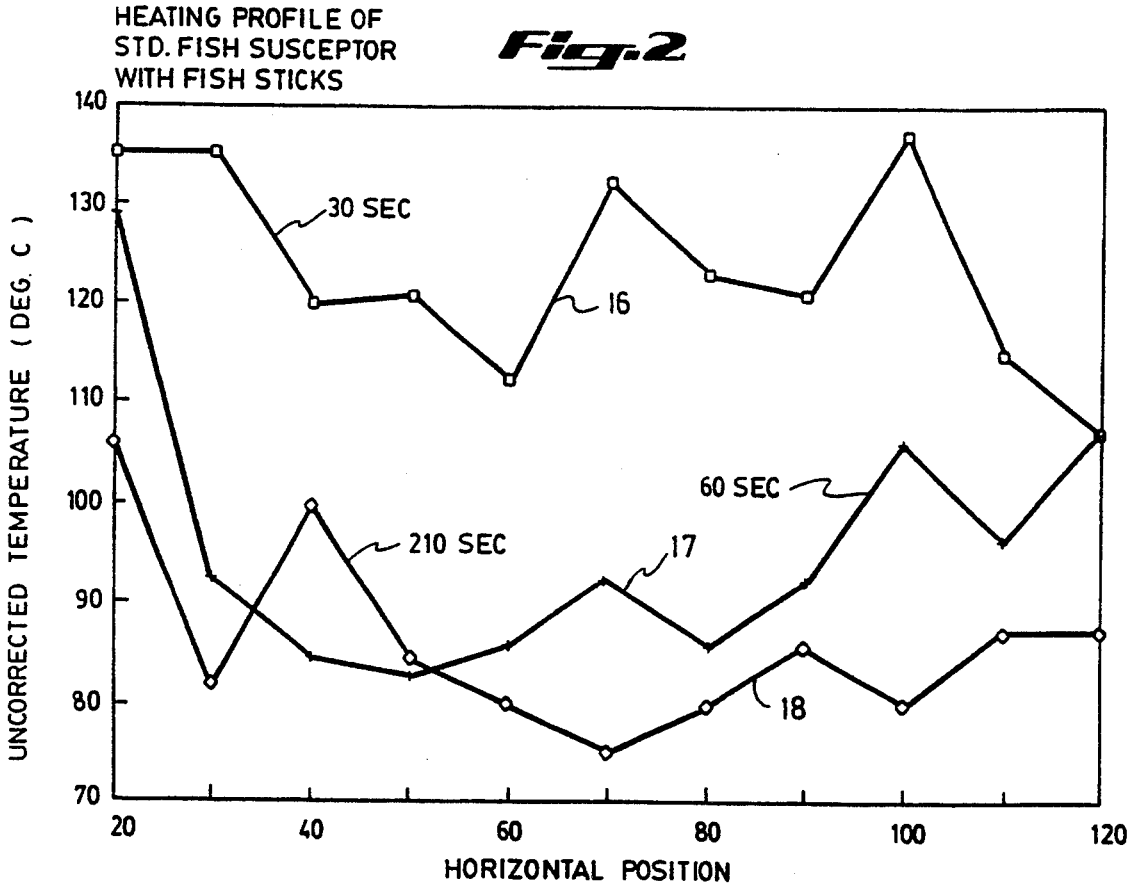
FIG. 2 is a graph showing the heating profile of a susceptor pad that was not constructed in accordance with the present invention.

FIG. 2 illustrates the heating profile of a susceptor pad used to heat fish sticks in a microwave oven. FIG. 2 involves a susceptor pad which did not have variable sized susceptor areas 13 and 14. The temperature of various positions on the horizontal center line of the susceptor pad were measured using an infrared camera. Line 16 represents the temperature profile of a susceptor pad after exposure to microwave radiation for 30 seconds. Line 17 represents the temperature profile of the same susceptor pad after exposure to microwave radiation for 60 seconds. Line 18 represents the temperature profile of the same susceptor pad after exposure to microwave radiation for 210 seconds.

As shown in FIG. 2, the temperature of the center of the susceptor pad quickly heated to a relatively high temperature within 30 seconds, and then dropped by the time that the 60 seconds temperatures were measured. The temperature of the center of the susceptor pad remained low through 210 seconds of microwave irradiation, as shown by line 18. However, the edges of the susceptor pad remained at relatively high temperatures. The result was that fish sticks at the end regions of the susceptor pad were more crisp than fish sticks located in the center region of the susceptor pad. Nonuniform crispening of the fish sticks was observed. The total cooking time for the fish sticks was approximately 3½ to 4 minutes.

The temperatures were measured with an infrared camera. The temperatures are "uncorrected" because the infrared camera was aimed through a wire mesh shield. The wire mesh shield was used to prevent leakage of microwave energy from the microwave oven. The wire mesh probably resulted in lower average temperature readings on the infrared camera. However, here the relative temperature differences are of primary interest. Thus, although the actual temperatures measured may not be precisely accurate, the relative temperatures are believed to be accurately portrayed.

Figure 3:
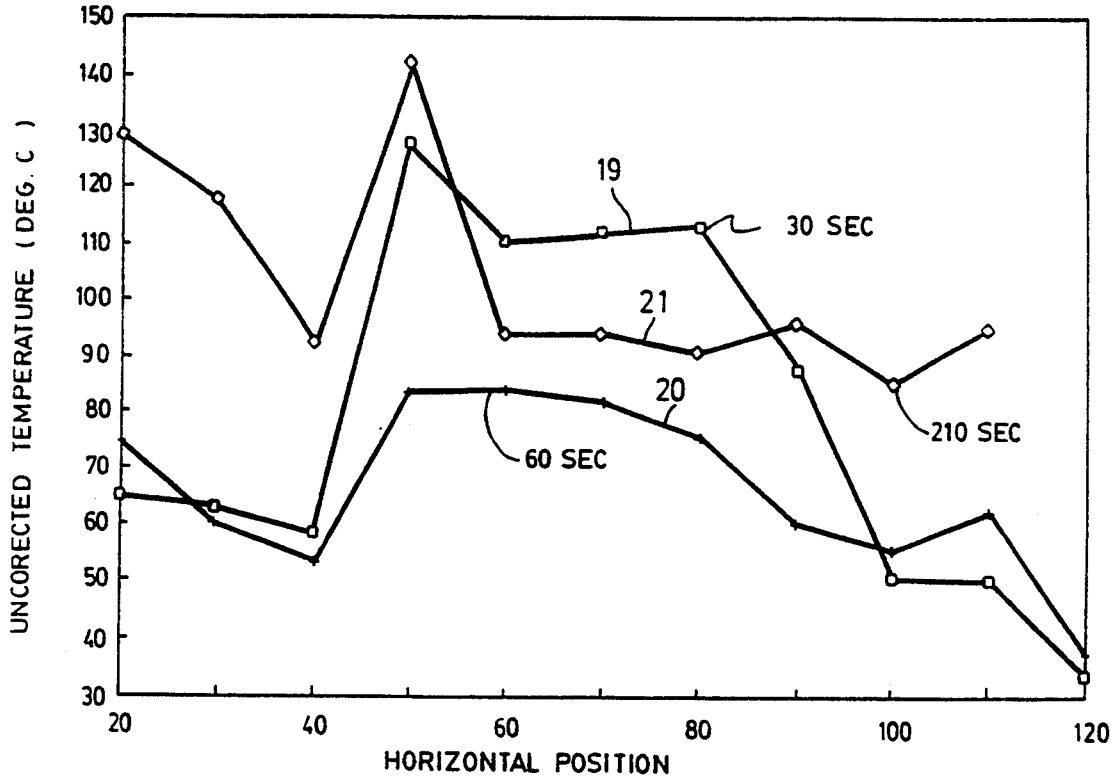
FIG. 3 is a graph showing the temperature profile of a similar susceptor pad, but which used regions with different sized susceptor areas in accordance with the present invention.

FIG. 3 represents temperature profiles of a susceptor pad 10 constructed in accordance with FIG. 1. As shown in FIG. 3, the relative heating of the center region 11 as compared with the end regions 12 was effected by the use of smaller susceptor areas 14 on the end regions 12.

Line 19 represents the temperature profile of the susceptor pad 10 after 30 seconds of exposure to microwave radiation. Line 20 represents the temperature profile of the susceptor pad 10 after exposure to microwave radiation for 60 seconds. Line 21 represents the temperature profile after exposure to microwave radiation for 210 seconds. The temperature of the end regions 12 remained relatively low at the 30 seconds measurement represented by line 19, and at the 60 seconds measurement represented by line 20. The temperature of the end regions 12 did rise toward the end of the heating period, as shown by line 21.

Figure 4:
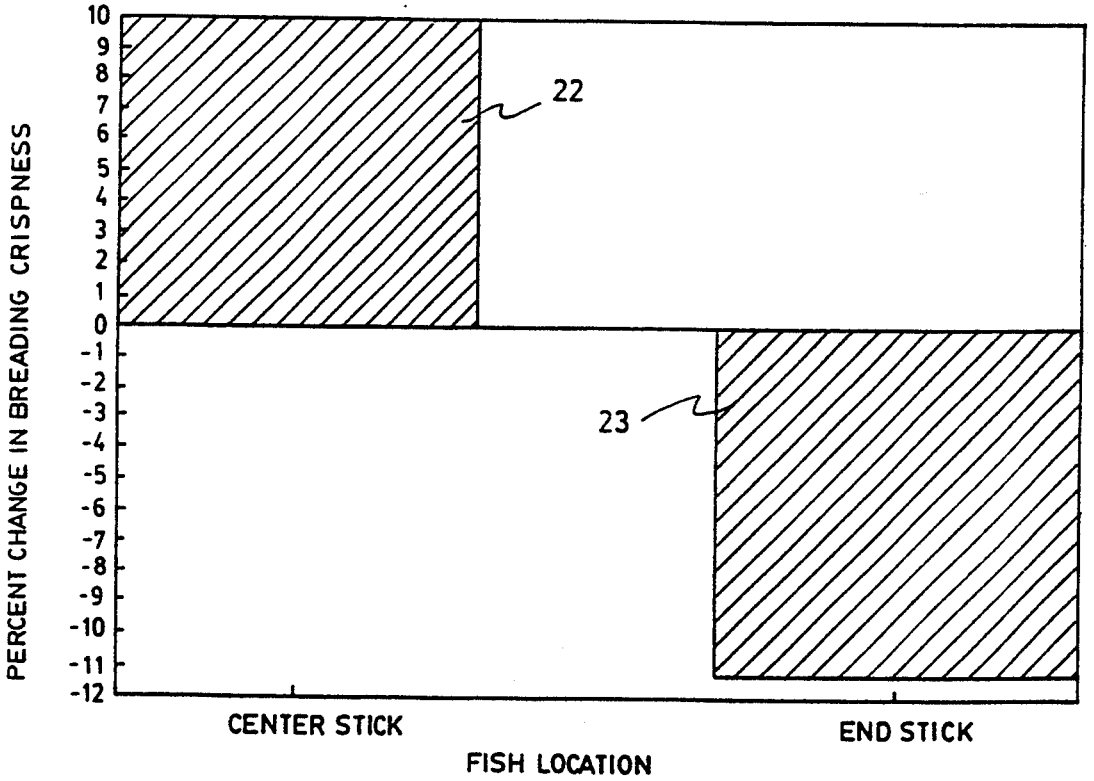
FIG. 4 is a bar graph illustrating the effect of different sized susceptor areas formed in accordance with the present invention on crisping.

FIG. 4 is a graph representing the effect of the smaller susceptor areas 14 on the end regions 12 and the larger susceptor areas 13 in the center region 11 upon the crispness of fish sticks. A plurality of fish sticks was arranged on the susceptor pad 10 illustrated in FIG. 1. The fish sticks were placed parallel to each other in side-by-side relationship. The length of the fish sticks was oriented vertically in FIG. 1. In other words, the length of the fish sticks was oriented in the same direction as the width of the susceptor pad 10. Thus, some fish sticks lay entirely in contact with the end regions 12, while other fish sticks lay in contact entirely with the center region 11.

In a test using a trained sensory panel, fish sticks in contact with the center region 11 averaged about a 10% change (increase) in breading crispness, as shown by bar graph 22 in FIG. 4. Fish sticks prepared on standard susceptors and on scored susceptors were compared by the panel. Fish sticks in contact with the end region 12 of the susceptor pad 10 experienced a −11% change (decrease) in breading crispness, as shown by bar graph 23 in FIG. 4. The percentage changes were based upon a comparison with fish sticks cooked on a susceptor pad which did not contain variable susceptor areas 13 and 14. Thus, the use of variable susceptor areas 13 and 14 resulted in an increase in the crispness of fish sticks on the center region 11, and a decrease in the crispness of fish sticks on the end regions 12. The variable sized susceptor areas 13 and 14 therefore compensated for nonuniform heating which would have otherwise resulted during microwave irradiation of the combination of the susceptor pad and fish sticks.

Figure 6:
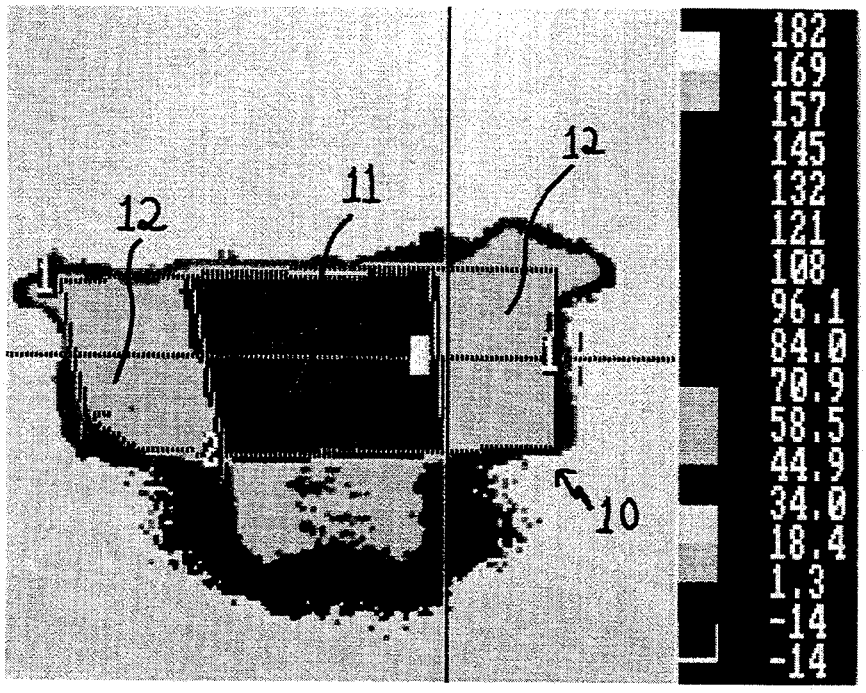
FIG. 6 is a similar image of the heating pattern of a susceptor which had variable sized susceptor areas in accordance with the present invention.

The effect of the variable sized susceptor areas 13 and 14 is further illustrated by a comparison of FIG. 5 with FIG. 6. FIG. 5 represents an image taken with an infrared camera during microwave irradiation of a susceptor pad which did not include variable sized susceptor areas 13 and 14. FIG. 6 illustrates the temperature profile of a susceptor constructed in accordance with FIG. 1. The infrared image of FIG. 6 was taken after 30 seconds of exposure to microwave radiation. FIG. 6 corresponds with the 30 second temperature profile shown in FIG. 3 (represented by line 19). FIG. 6 shows that the microwave heating of the end regions 12 was greatly reduced as compared with the center region 11.

In the susceptor pad 10 illustrated in FIG 1, the small susceptor areas 14 are formed in the shape of squares which are approximately 1/16 inch on each side. In other words, the small susceptor areas 14 are formed in the shape of squares having a height and width of 0.0625 inch.

The large susceptor areas 13 in the center region 11 of the susceptor pad 10 illustrated in FIG. 1 are formed in the shape of rectangles having a length of $1\frac{1}{4}$ inches and a width of 7/8 inch. In other words, the large susceptor areas 13 have a length of 1.25 inches and a width of 0.875 inch.

The overall length of the illustrated susceptor pad 10 was $6\frac{1}{2}$ inches. The overall width was $3\frac{3}{4}$ inches. Each end region 12 was about 2 inches by $3\frac{3}{4}$ inches. The center region 11 was about $2\frac{1}{2}$ inches by $3\frac{3}{4}$ inches. The scores 15 used for separating the small and large susceptor areas 14 from each other and from adjacent large susceptor areas 13 were the width of a razor blade cut in the metallized polyester layer.

Figure 7:
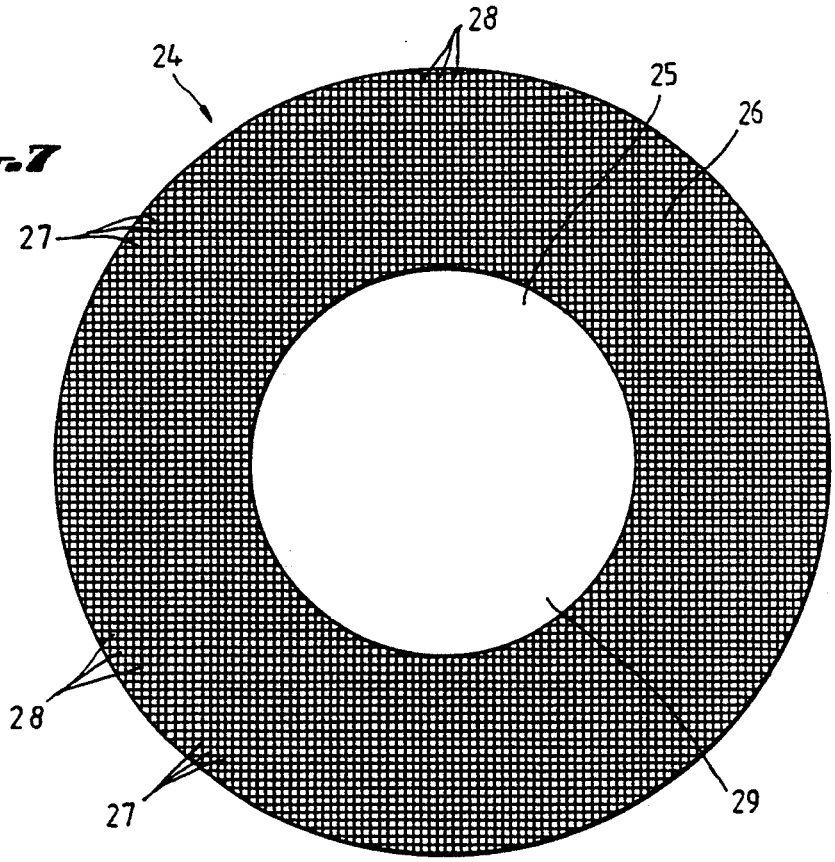
FIG. 7 is a top view of a susceptor having variable susceptor areas in accordance with the present invention for use in crisping the surface of food products such as pizza.

FIG. 7 illustrates a round susceptor pad 24 used for browning the crust of a pizza or the like. In the case of a round susceptor for use in heating pizza, it has been found that the outer perimeter of the susceptor pad tends to heat much more than the center region of the susceptor pad. This often results in a browning of the outer surface area of the pizza crust, while only 50–60% of the center area of the pizza crust is browned. This is shown by the information depicted in FIG. 8 and FIG. 10, which will be explained in more detail below.

It is desirable to have some means for reducing the heating of the outer region 26 of the susceptor pad 24, while increasing the relative heating of the center region 25 of the susceptor pad 24. In the present invention, this is accomplished by providing conductivity breaks or scoring 27 in the outer region 26 of the susceptor pad 24. The scores 27 may be in the form of cuts made with a razor blade or the like. It is sufficient if the scores 27 are made in any manner which disrupts or breaks the electrical conductivity of the metallized layer of the susceptor pads 24.

The scores 27 define small susceptor areas 28 in the outer region 26 of the susceptor pad 24. The center region 25 defines a larger susceptor area 29. The small susceptor areas 28 are less responsive to the heating effects of microwave radiation, as compared with the large susceptor area 29. This has the effect of reducing the level of heating in the outer region 26 of the susceptor pad 24, where the susceptor 24 would otherwise tend to overheat. The provision of variable susceptor areas 26 and 29 has the effect of increasing the temperature of the center region 25 relative to the outer region 26.

Figure 8:
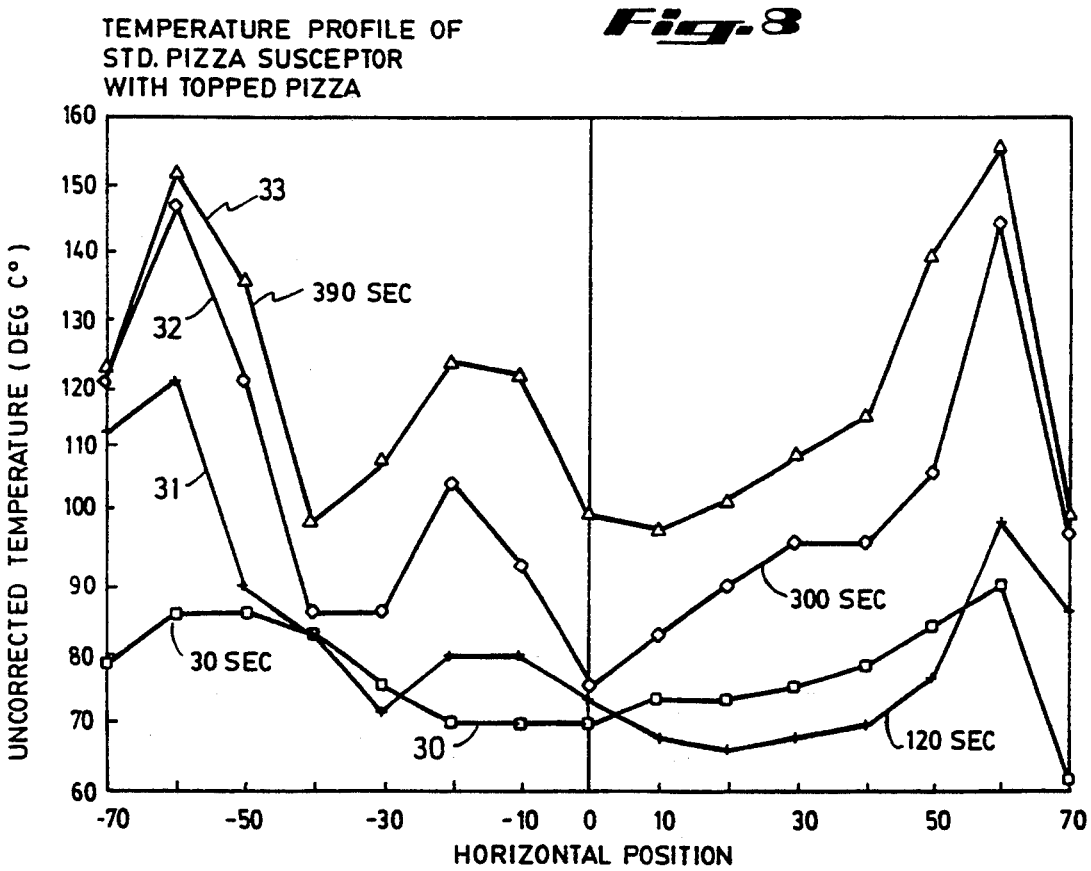
FIG. 8 is a graph representing the temperature profile of a round pizza susceptor which did not have graduated sized areas in accordance with the present invention.

FIG. 8 is a graph illustrating temperature profiles of a round susceptor pad used for browning the crust of a pizza. Line 30 represents temperature measurements at various horizontal positions of the susceptor pad after 30 seconds of exposure to microwave radiation. Line 31 represents temperature measurements at the same locations after exposure to microwave radiation for 120 seconds. Line 32 represents temperature measurements after exposure to microwave radiation for 300 seconds. Line 33 depicts temperature measurements after 390 seconds of exposure to microwave radiation. FIG. 8 shows that the outer portion of the susceptor pad became much hotter than the center portion of the susceptor pad.

Figure 9:
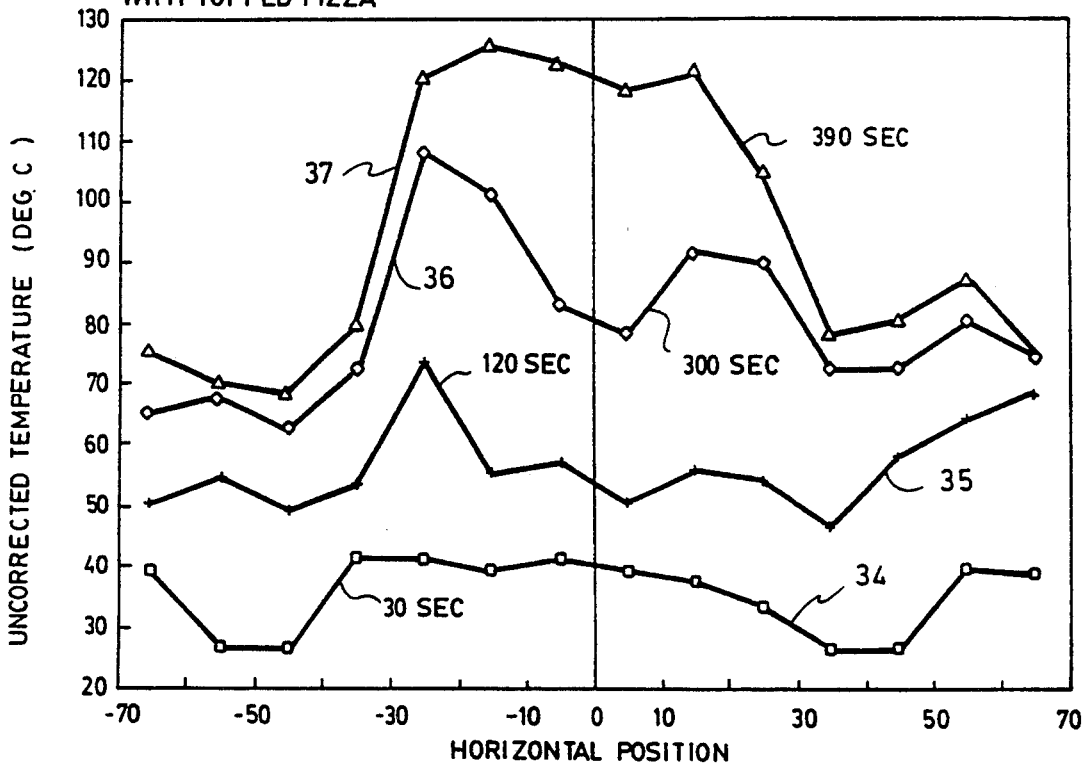
FIG. 9 is a graph showing a temperature profile of a similar susceptor, but which did have graduated sized susceptor areas as shown in FIG. 7.

FIG. 9 illustrates the temperature profile of a susceptor pad 24 constructed in accordance with she embodiment illustrated in FIG. 7. Line 34 shows temperature measurements at various horizontal positions on the susceptor pad 24 after exposure to microwave radiation for 30 seconds. Line 35 depicts temperature measurements after 120 seconds of exposure to microwave radiation. Line 36 shows temperature measurements after 300 seconds of exposure. Line 37 depicts temperature measurements taken after 390 seconds of exposure to microwave radiation.

A comparison of FIG. 9 with FIG. 8 shows that the use of variable susceptor areas 28 and 29 dramatically change the temperature profile of the pizza susceptor 24. The center region 25 became much hotter after 390 seconds of exposure, than did the center region of a susceptor pad which was not constructed in accordance with the present invention. The temperature of the outer region 26 reduced, while the temperature of the center region 25 was increased.

Figure 10:
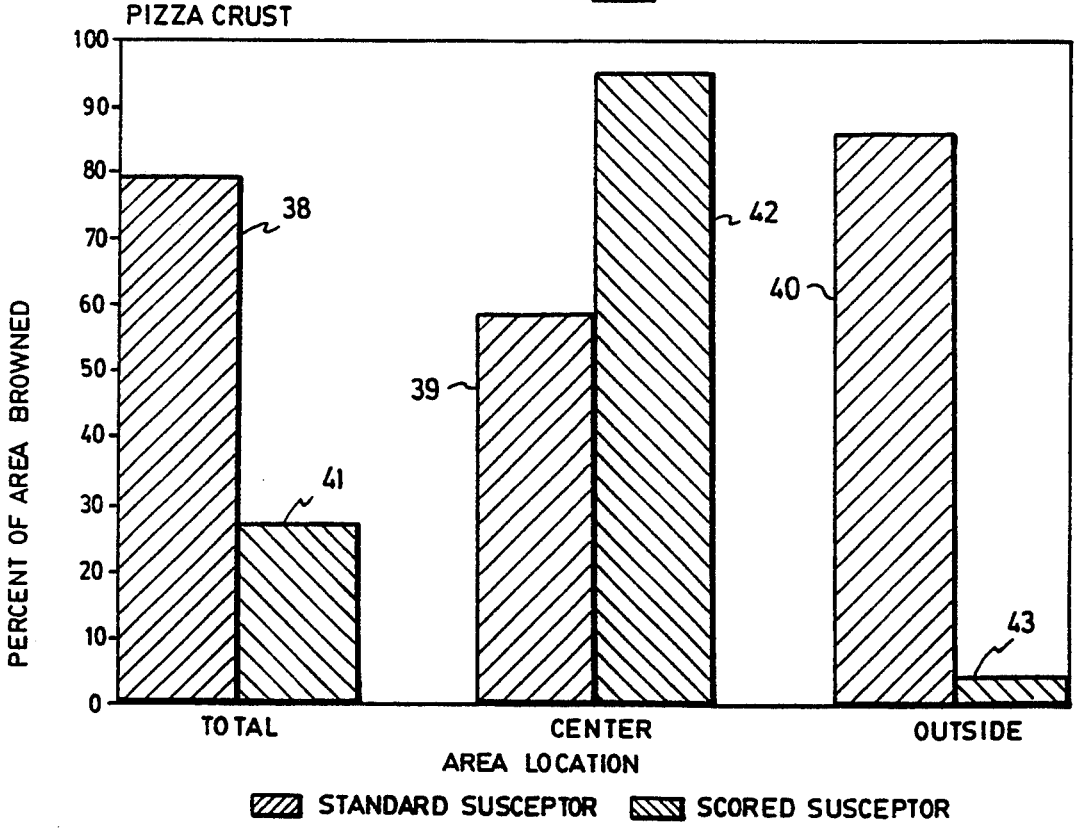
FIG. 10 is a bar chart illustrating the effect of variable sized susceptor areas using a susceptor pad constructed in accordance with FIG. 7 on browning.

FIG. 10 is a bar chart illustrating the effect upon browning of the pizza crust as a result of the use of different sized susceptor areas 28 and 29 on the susceptor pad 24. The bar chart represents the percentage of crust area which was browned after microwave heating.

Bar 38 in FIG. 10 represents the percentage of crust area which was browned using a susceptor pad that did not have different sized susceptor areas. Slightly less than 80% of the pizza crust area was browned in this instance. More than about 85% of the area of the outside of the pizza crust was browned, as shown by bar 40 in the bar chart of FIG. 10. However, less than 60% of the center area of the pizza crust was browned, as shown by bar 39 in FIG. 10.

Using a susceptor pad 24 having different sized susceptor areas 28 and 29, as shown in FIG. 7, the amount of browning which occurred in the center region 25 was greatly increased, while the amount of browning which occurred in the outer region 26 was greatly decreased. Bar 42 represents the amount of browning which occurred in the center region 25. About 95% of the area of the crust in the center region 25 was browned in this instance. Only about 5% of the area of the crust in the outer region 26 was browned, as shown by bar 43 in FIG. 10. The total percentage of the area of the crust which was browned was less than 30%, as shown by bar 41 in FIG. 10.

Figure 11:
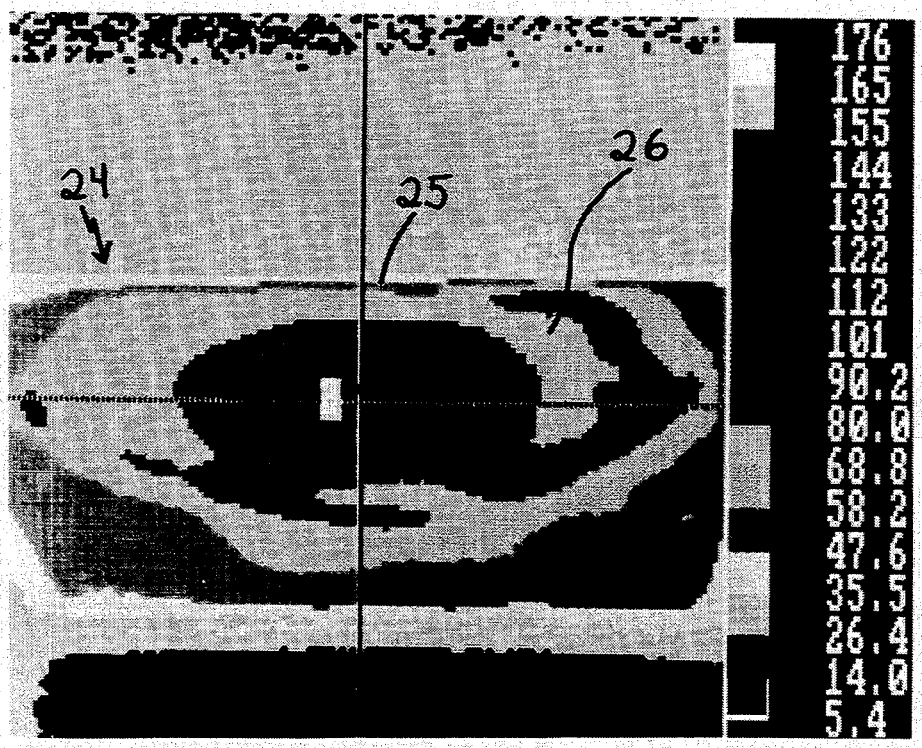
FIG. 11 is an image of the heating pattern of a susceptor constructed in accordance with FIG. 7. The image was created with an infrared camera.

FIG. 11 is an image taken with an infrared camera depicting the heating pattern of a susceptor pad 24 constructed in accordance with the embodiment illustrated in FIG. 7. The infrared image was taken at a point during the heating period corresponding to three hundred ninety seconds of exposure to microwave radiation. The infrared image of FIG. 11 corresponds with line 37 depicted in the temperature profile graph of FIG. 9. The areas corresponding to the center region 25 and the outer region 26 are marked in FIG. 11.

In the particular susceptor pad 24 illustrated in FIG. 7, the diameter of the susceptor 24 was nine inches. The diameter of the center region 25 was about 4.5 inches. The small susceptor areas 28 were formed generally as squares having a height and width of about 1/16 inch, or 0.0625 inches. The scores 27 were formed by razor blade cuts in the metallized layer of the susceptor pad 24.

When one region 26 of a susceptor 24 is made less responsive to microwave heating, the amount of heating of a nondisrupted region 25 may be increased. This phenomenon is referred to as "load sharing." it is believed that when one region 26 is made less responsive to microwave heating, there is more energy available to heat other regions 25.

Figure 12:
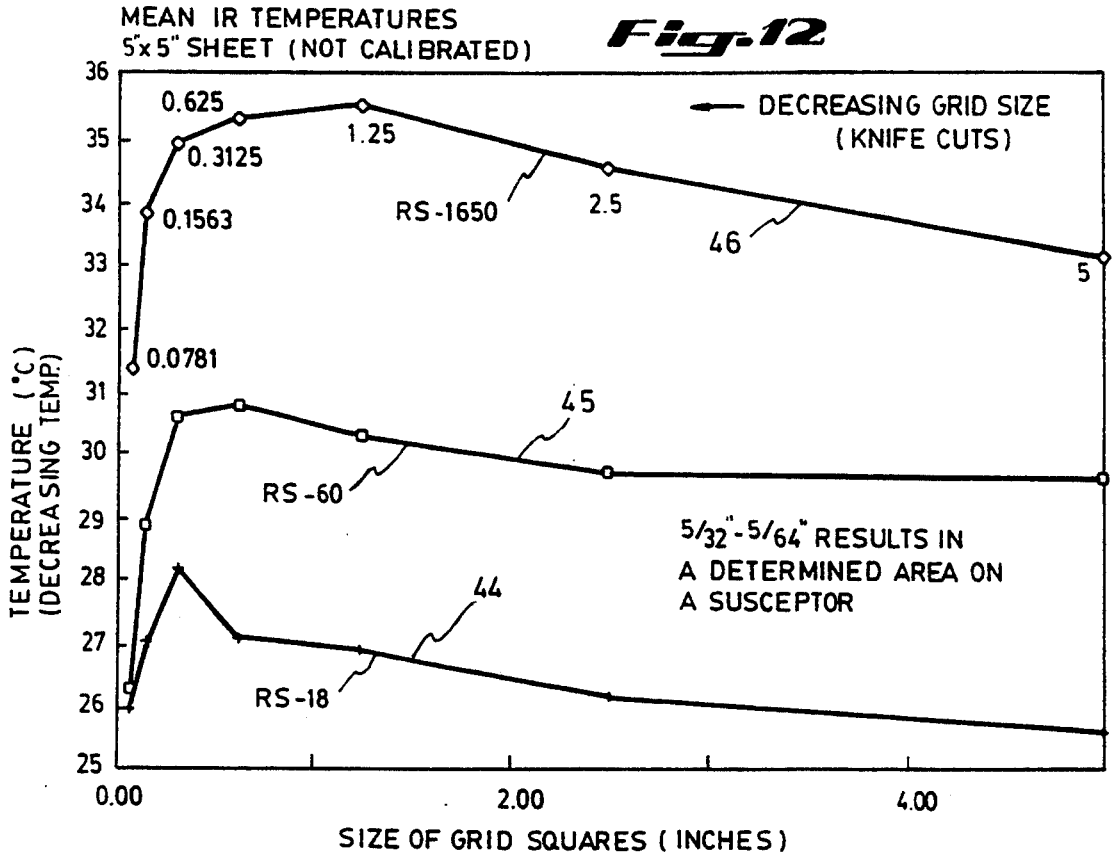
FIG. 12 is a graph depicting the temperature reached during microwave heating as a function of the size of the susceptor areas.

FIG. 12 is a graph depicting the heating effect of small susceptor areas 14 as a function of the size of the area. In this case, the susceptor areas were formed as squares. The indicated dimensions are the height and width of the squares.

FIG. 12 shows that the responsiveness of small susceptor areas 14 to the heating effects of microwave radiation rapidly decreases when the squares 14 are made smaller than 0.625 inches on a side where the metallized susceptor pad 10 has a relatively large resistivity of 1650 ohms per square. For lower resistivities on the order of eighteen ohms per square, the responsiveness of the small squares 14 to the heating effects of microwave radiation decreases when the squares are made smaller than 0.3125 inches on each side.

In FIG. 12, line 44 depicts the temperature as a function of size for small squares 14 where the resistivity of the metallized layer of the susceptor pad 10 is eighteen ohms per square. Line 45 depicts the temperature as a function of size of squares 14 where the resistivity of the metallized layer of the susceptor pad 10 was sixty ohms per square. Line 46 depicts the temperature as a function of size for susceptor areas 14 where the resistivity of the metallized layer was 1650 ohms per square. These temperatures have not been corrected for the differences in emissivity of the susceptor surface. The relative temperatures along each line (44, 45, 56) are correct. The comparative heating between susceptors of different resistivities is affected by emissivity differences of the susceptor surfaces and has not been corrected in FIG. 12.

Figure 13:
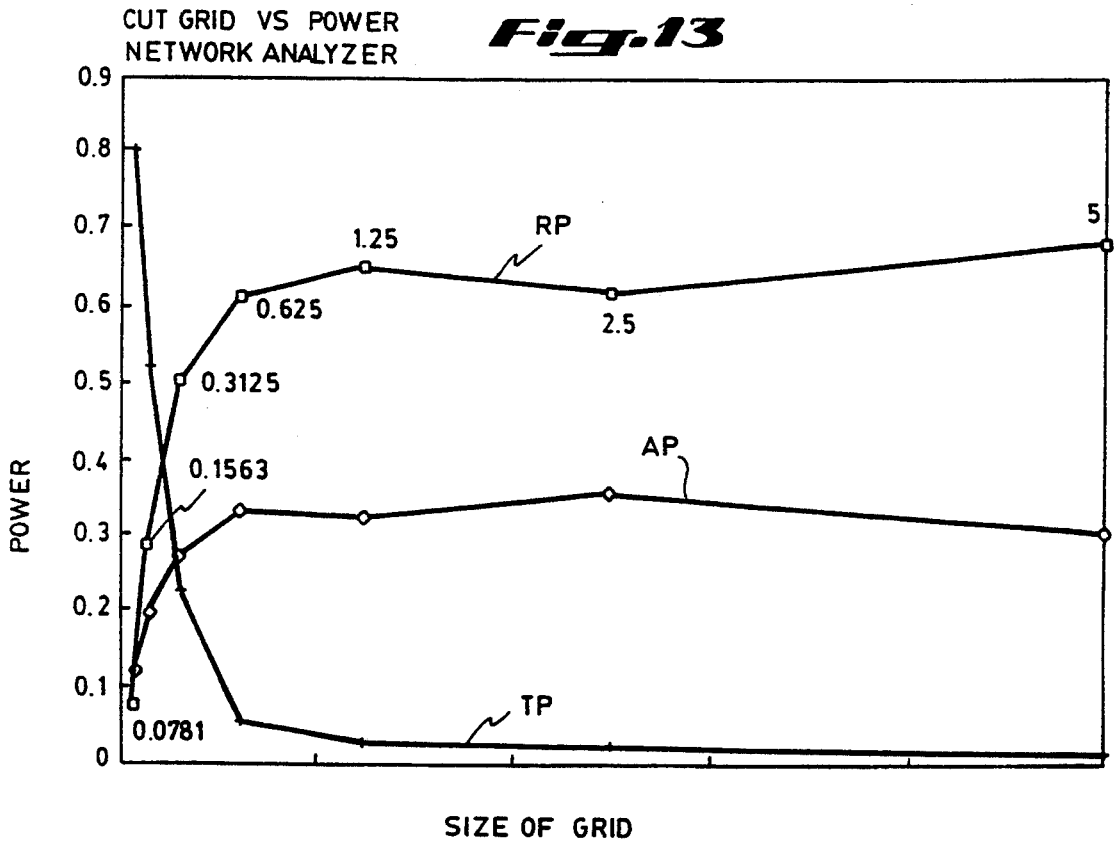
FIG. 13 is a graph showing the percent power absorbed, transmitted, and reflected as a function of the size of the susceptor areas.

FIG. 13 depicts data taken with a network analyzer for the susceptor pad 10 which was 60 ohms per square, and which formed the basis for the measurements depicted in FIG. 12 by line 45. A 5-inch square uncut susceptor 10 provided reflectance, transmission and absorption measurements which are shown on the far right-hand portion of the graph of FIG. 13. For the uncut pad, the absorption was measured at about 30%. The reflection was measured at about 68%. The transmission was measured at about 2%.

FIG. 13 shows that the reflection, transmission and absorption of a susceptor pad 10 are affected by disruptions or conductivity breaks in the susceptor surface. The curves begin to change significantly when the size of the squares 14 created by the disruptions or breaks in conductivity were made 0.625 inch on a side, or smaller. The percentage power absorbed decreased significantly for squares which were 0.625 inch on a side, or smaller. An absorption of about 33% was measured for squares 14 having a width of 0.625 inch. An absorption of about 27% was measured for squares 14 having a width of about 0.3125 inch. An absorption of about 20% was measured for squares 14 having a width of about 0.1563 inch. An absorption of about 11% was measured for squares 14 having a width of about 0.0781 inch.

All measurements were taken by the network analyzer prior to heating of the susceptor pad 10 in a microwave oven. This technique, i.e., using network analyzer data, may be used to determine the reduced responsiveness of susceptor pad regions which have disruptions or conductivity breaks that form complex patterns which may not define simple squares 14 as depicted in the above examples. Thus, it should be appreciated that reduced responsiveness to microwave heating can be achieved using disruption patterns or conductivity breaks of various configurations, in addition to the illustrated example of squares 14.

Figure 14:
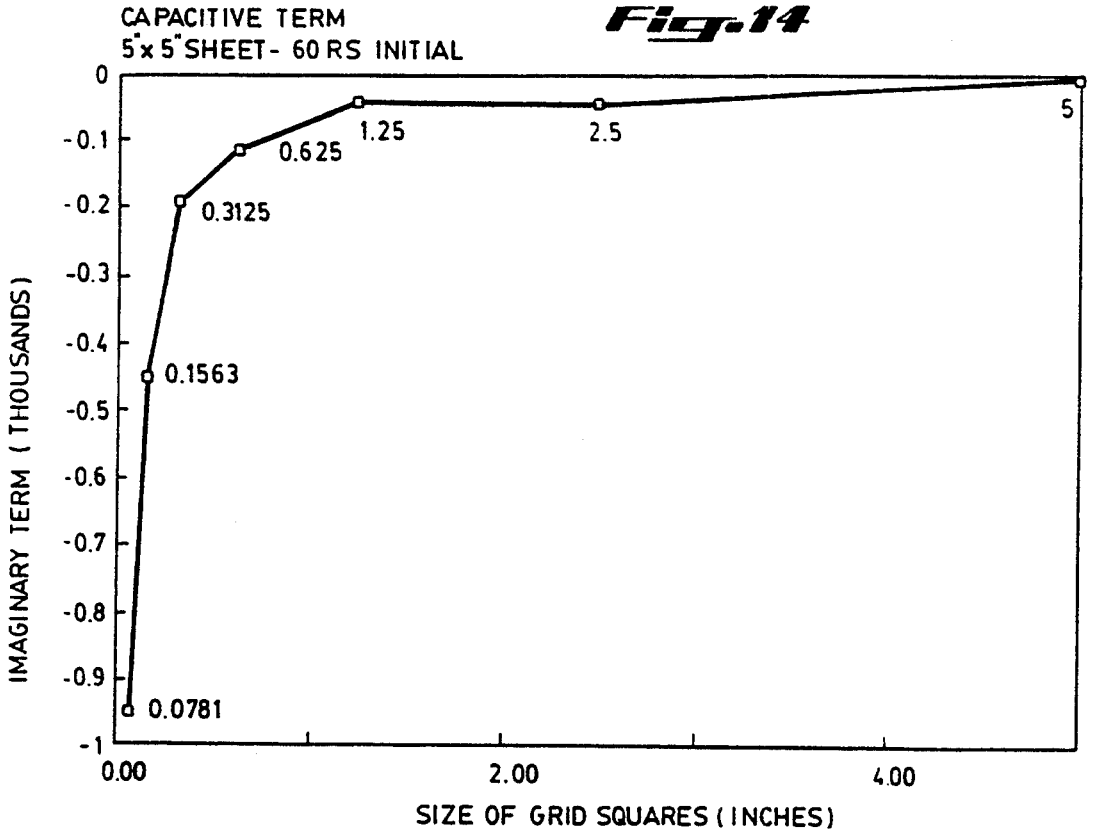
FIG. 14 is a graph of capacitance reactance as a function of the size of the susceptor areas.

The effect of disruptions or conductivity breaks in the susceptor surface may be better understood with respect to FIG. 14. FIG. 14 is a graph depicting the effect upon the reactive component of the impedance of a susceptor pad when small squares 14 are formed in the susceptor surface. The data plotted on FIG. 14 was measured with a network analyzer, using the same susceptor pad which had an initial resistivity of 60 ohms per square. More specifically, the impedance of the susceptor pad was essentially all resistive prior to cutting, as shown by the point at the upper right-hand corner of the graph, measured for the uncut 5-inch square susceptor pad.

Conductivity breaks in the surface of the susceptor pad created a negative reactance, i.e., a capacitive reactance. The total impedance $Z_S$ of the susceptor pad may be expressed as:

$$Z_S = R_S - jX_S$$

where $R_S$ is the resistance component of the impedance, and $X_S$ is the reactance component of the impedance. If $X_S$ is positive, then the reactance is inductive. If $X_S$ is negative, then the reactive component is capacitive. When the surface of the susceptor is discontinuous, as a result of disruptions or breaks in the conductivity of the susceptor pad surface, the susceptor typically demonstrates a capacitive reactance.

Measuring the reactance of the susceptor surface provides an indication of the magnitude of the discontinuity or disruption of a region of the susceptor surface. This is proportional to the extent to which the responsiveness of that region to heating during microwave irradiation will be affected by the discontinuity or disruption in the susceptor pad surface.

The relative difference in the capacitive reactance of various regions of the susceptor pad 10 resulting from disruptions in the susceptor surface may be used as a means of determining whether one region will be less responsive to the heating effects of microwave radiation as compared to another region of the susceptor pad 10. Thus, complex patterns may be used to create disruptions in the susceptor pad surface. Measurements with the network analyzer may be used for determining the changed responsiveness of a region of the susceptor pad to the heating effects of microwave radiation as a result of any complex pattern of disruptions.

Figure 15:
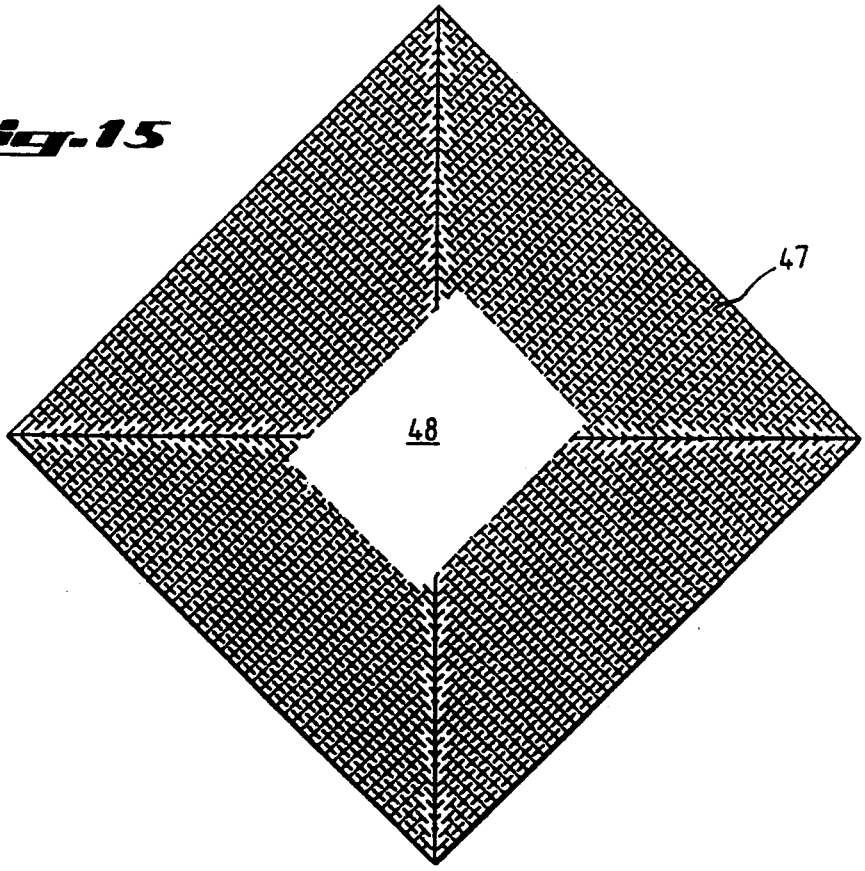
FIG. 15 is a top view of an alternative embodiment of a susceptor utilizing a maze pattern to decrease the microwave heating effect upon a disrupted region of the susceptor.

FIG. 15 illustrates an embodiment of a susceptor pad surface having a complex "maze" pattern forming disruptions in the susceptor pad surface. For complex patterns such as shown in FIG. 15, network analyzer measurements may be used for determining the relative responsiveness of various regions to microwave radiation.

FIG. 15 shows a first region 47 of the susceptor pad having discontinuities or disruptions in the form of a maze pattern. The disruptions in the first region 47 render it less responsive to the heating effects of microwave radiation than would be the case if the disruptions in the susceptor surface were not present in the first region 47. A second region 48 is also shown, in this example as a center rectangle of susceptor material.

Figure 16:
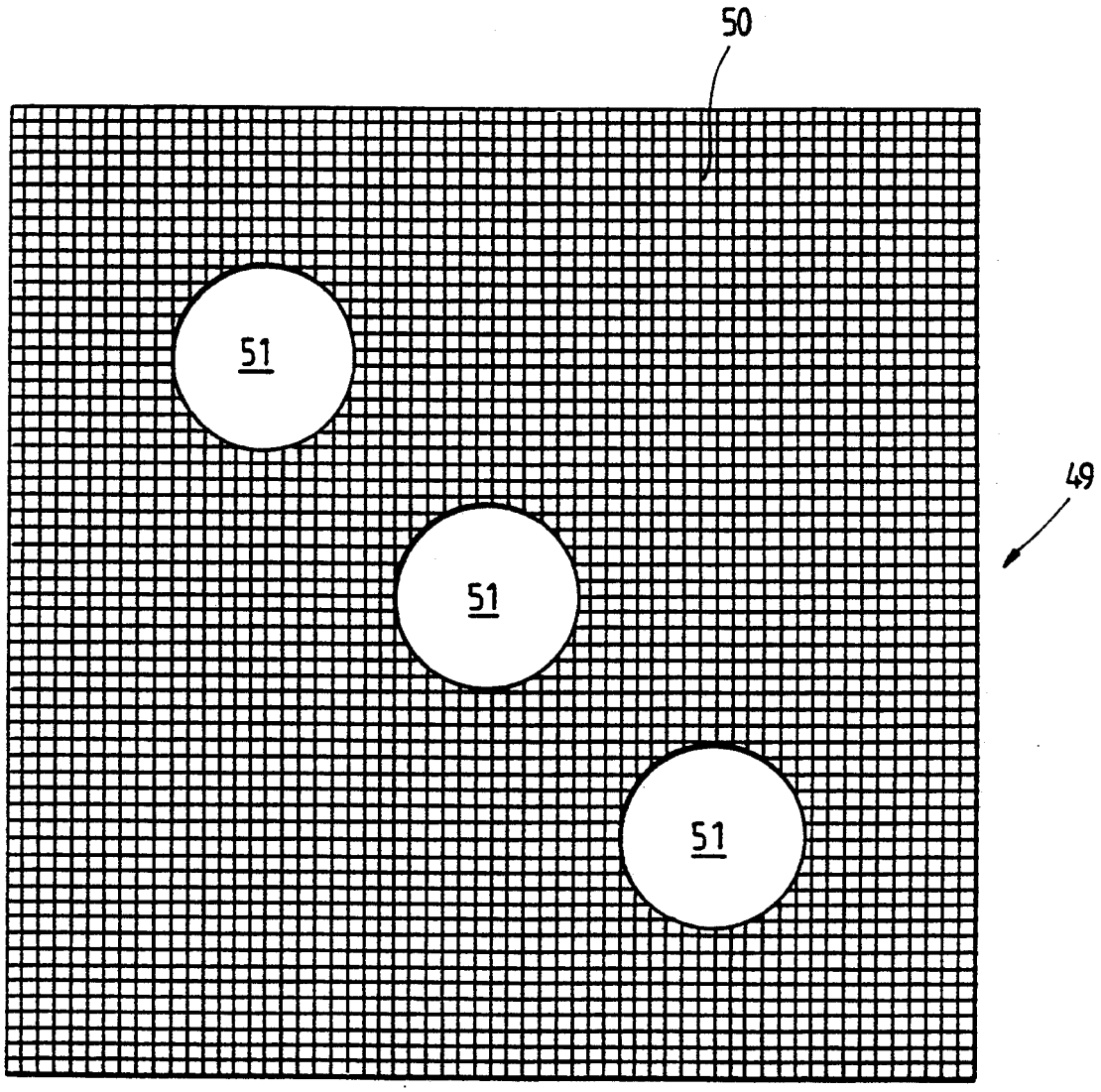
FIG. 16 is a top view of a susceptor demonstrating the effect upon microwave heating by disruption of the conductive sheet without cutting.

Disruptions in the susceptor surface do not necessarily have to take the form of cuts in the surface. The susceptor surface may be disrupted, for example, by drawing lines using a ball point pen. An example of the ability to achieve less responsiveness by disruptions created, for example, with a ball point pen, is shown in the experiment illustrated in FIG. 16. A square susceptor pad 49 was used in this experiment. A grid pattern covering a first region 50 was drawn on the susceptor pad 49 using a ball point pen. Three circular regions 51 were arbitrarily selected, and were not provided with disruptions. The relative heating of two susceptor pads is shown in FIGS. 17 and 18, without the grid pattern and with the grid pattern illustrated in FIG. 16, respectively.

Figure 17:
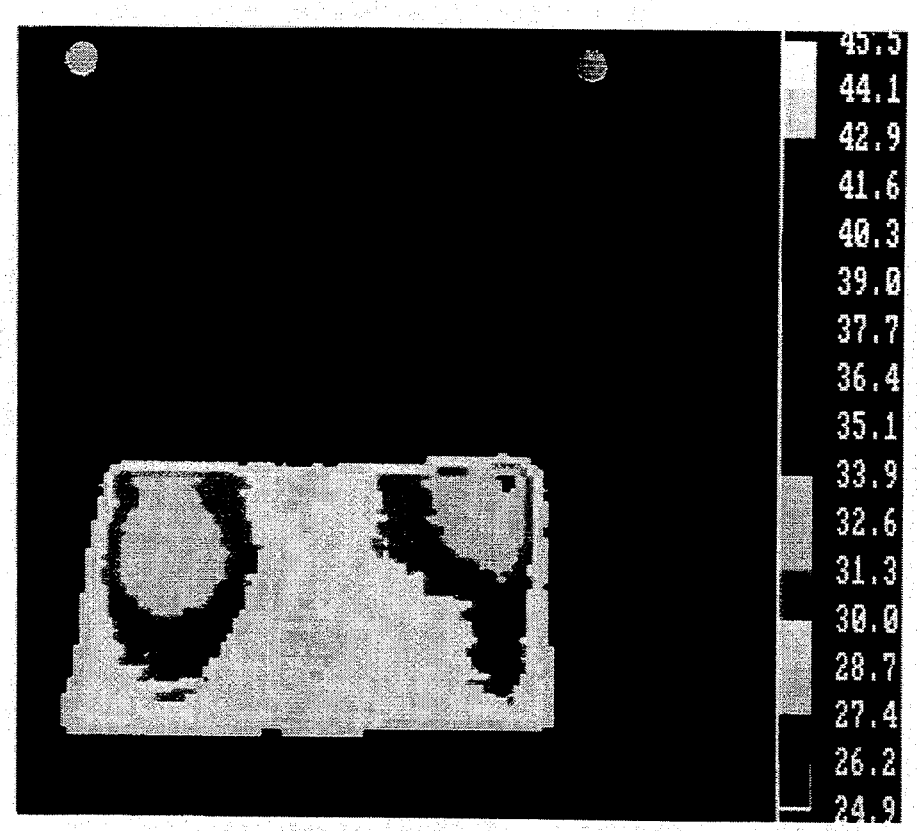
FIG. 17 is an infrared image of the microwave heating effects upon a susceptor without any disruptions.

FIG. 17 shows an image formed with an infrared camera showing the heating effects upon a susceptor pad without any disruptions. This susceptor pad was used as a control for the experiment.

Figure 18:
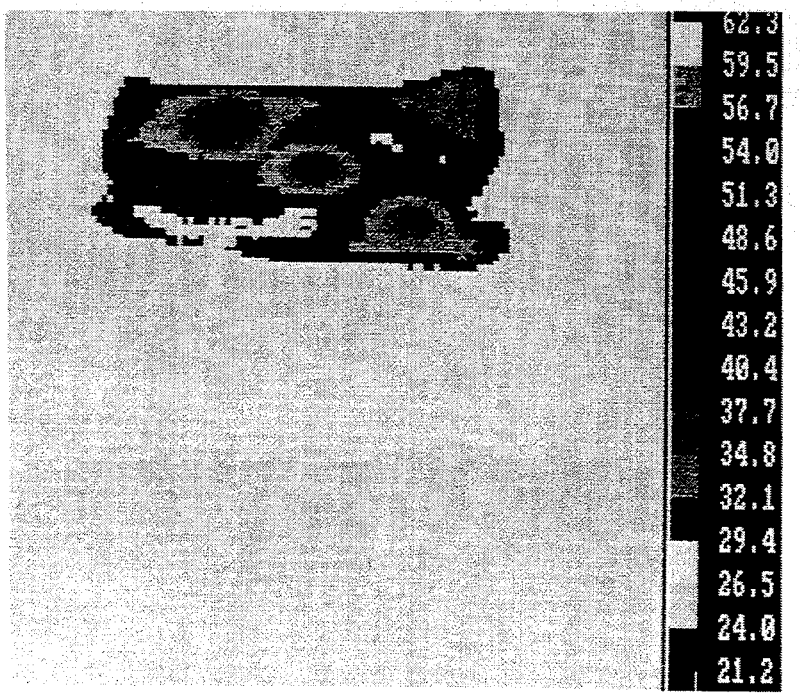
FIG. 18 is an infrared image of the microwave heating effects upon the susceptor illustrated in FIG. 16.

FIG. 18 is an infrared image of the heating effect upon a susceptor pad 49 having a grid pattern drawn on it using a ball point pen. The relative difference in the heating of the three circular regions 51 which did not have the susceptor pad surface disrupted is clearly apparent from the infrared image of FIG. 18. This experiment demonstrated the effectiveness of disruptions in affecting the heating response of a region of a susceptor pad. Thus, actual cuts in the susceptor pad surface are not required. Disruptions may be created by pressing or stamping the susceptor pad surface. Disruptions may be created which are virtually invisible. However, the effect of disruptions can be revealed by measurements taken using a network analyzer.

Figure 19:
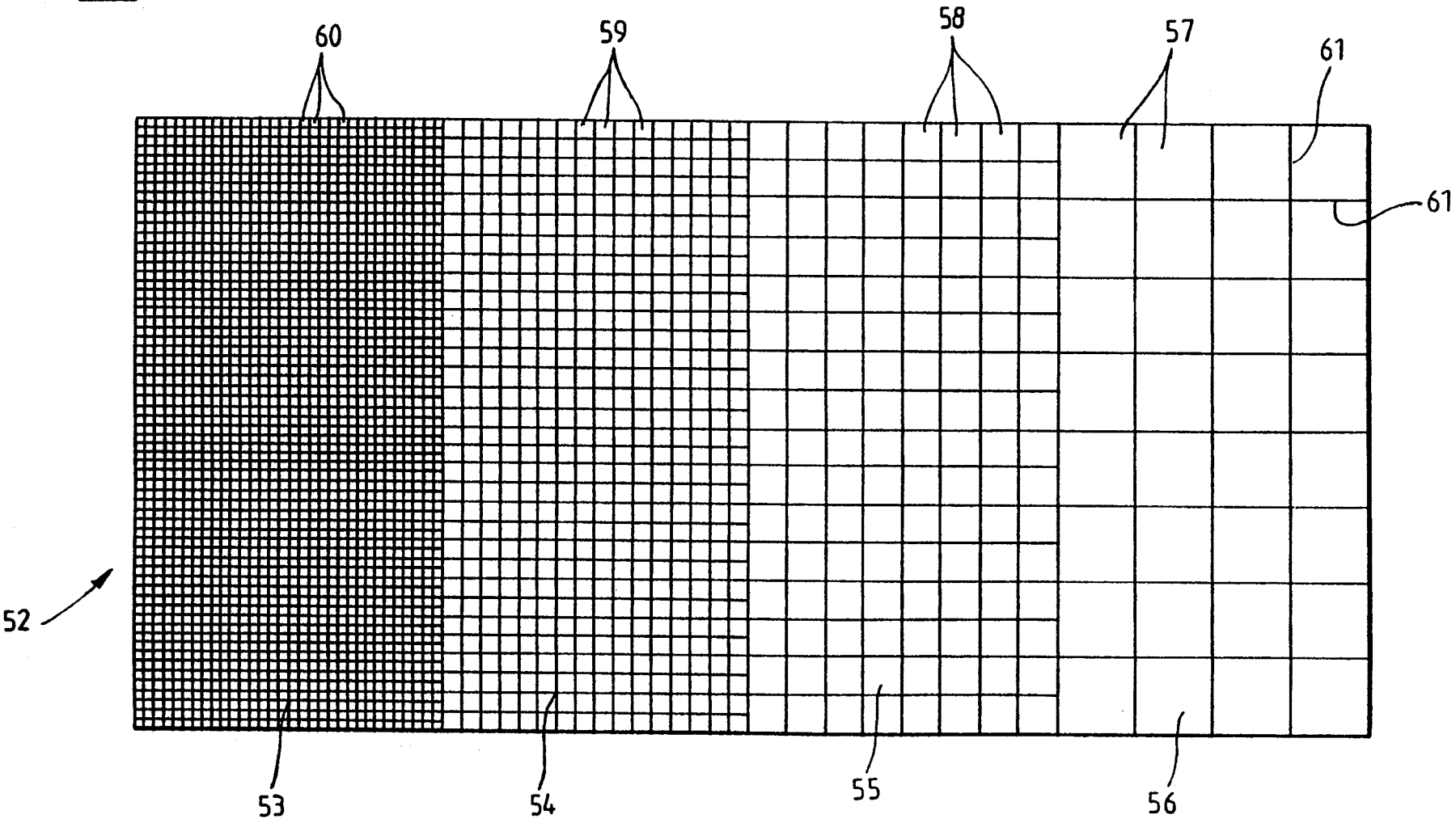
FIG. 19 is a top view of a susceptor having four different regions of responsiveness formed using the present invention.

FIG. 19 shows a susceptor pad 52 which has a first region 53, a second region 54, a third region 55 and a fourth region 56, each having different patterns of conductivity breaks in the surface of the susceptor pad 52. In this example, squares 57 were formed in the fourth region 56. The squares 57 had a width of ½ inch. The squares 57 were formed by making cuts 61 in the surface of the susceptor pad 52 using a razor blade.

The third region 55 had smaller squares 58 formed by cuts 61, which had a width of about ¼ inch. The second region 54 had even smaller squares formed therein which had a width of about ⅛ inch. The first region 53 had the smallest squares 60 formed by cuts 61, which had a width of about 1/16 inch.

Figure 20:
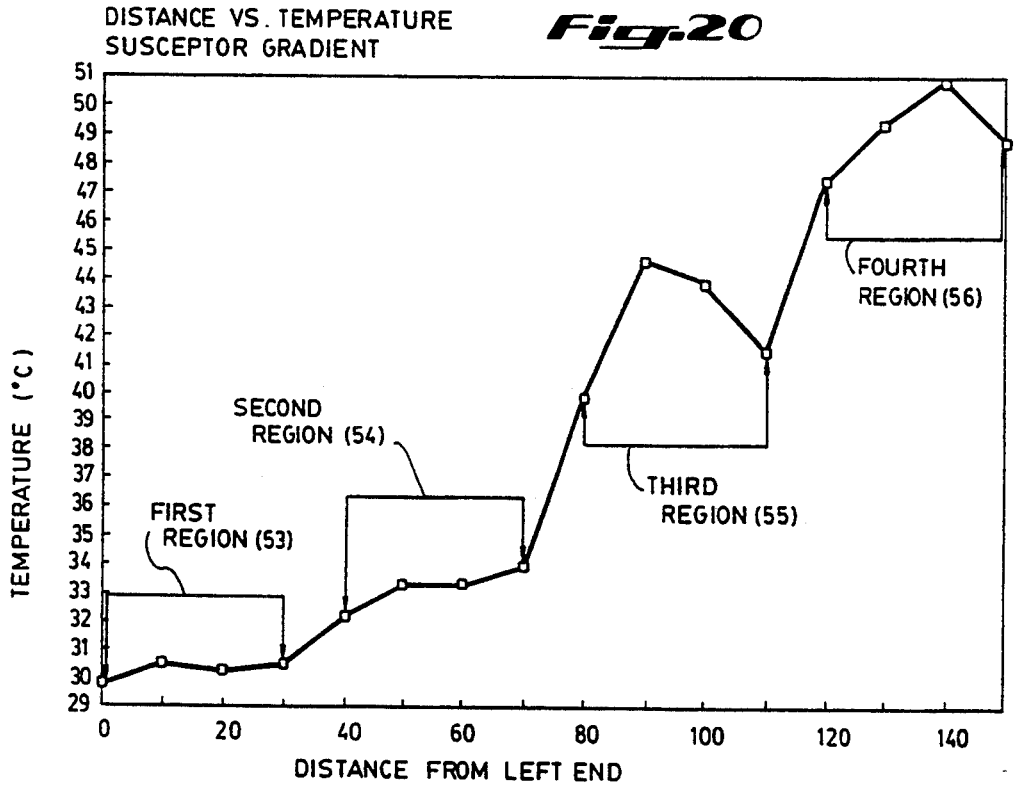
FIG. 20 is a graph depicting the temperature profile during microwave heating of the susceptor constructed in accordance with FIG. 19.

FIG. 20 illustrates the temperature profile of the susceptor pad 52 constructed in accordance with FIG. 19. The heating effects of the microwave radiation on the fourth region 56 was much greater than the heating effects upon the other regions 53, 54 and 55. The smaller the size of the squares in the region, the less heating was observed. Temperatures were measured using an infrared camera.

Cuts or disruptions in the surface of the susceptor may be used to create an effect which may be referred to as "directed flow." This may be illustrated with reference to the experiment depicted in FIGS. 21–25.

Figure 21:
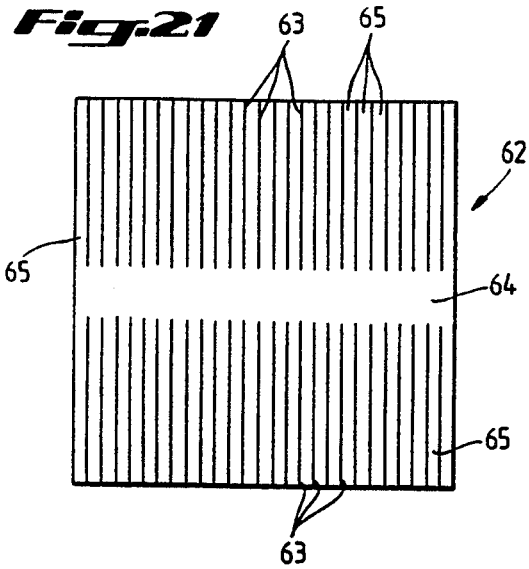
FIG. 21 is a top view of a susceptor using the principle of "directed flow."

FIG. 21 illustrates a susceptor pad 62. Parallel cuts 63 were made in the surface of the susceptor pad 62. A center uncut region 64 was left in the middle of the susceptor pad 62. The parallel cuts 63 defined strips 65 on the surface of the susceptor pad 62. There was no conductivity break or disruption between the end of each strip 65 and the center region 64 of the susceptor 62.

Figure 22:
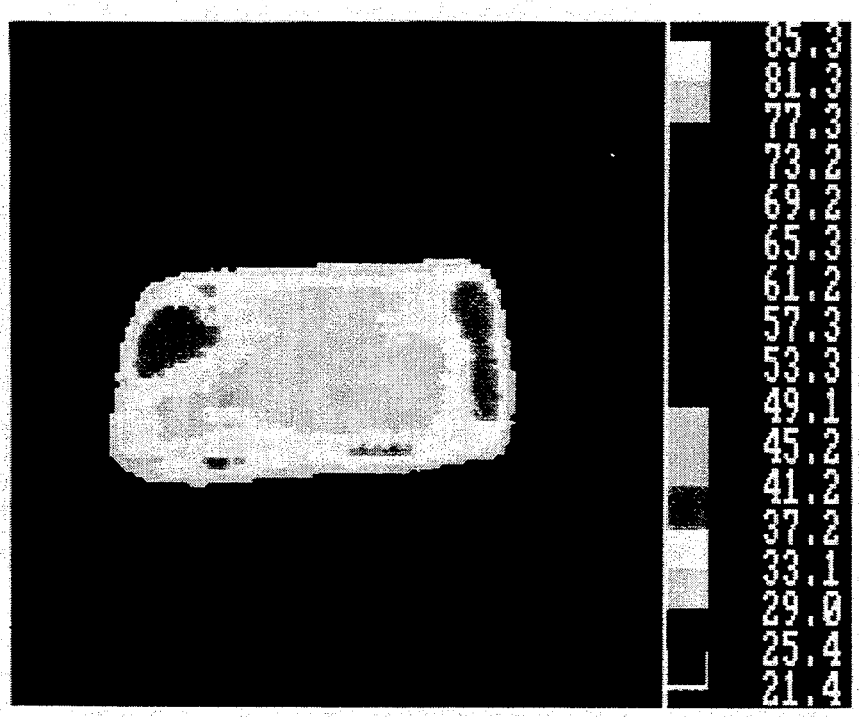
FIG. 22 is an infrared picture of the microwave heating effects upon a susceptor without being modified, which was used as a control example for comparison.
Figure 23:
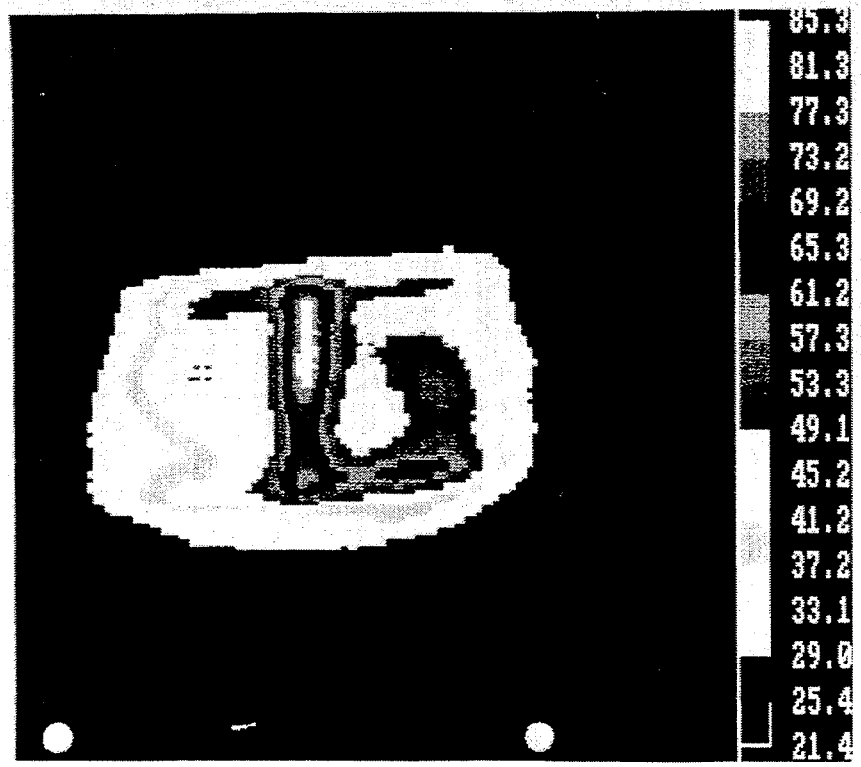
FIG. 23 is an infrared picture depicting microwave heating of a susceptor constructed in accordance with FIG. 21.

FIG. 22 is an image taken with an infrared camera showing the heating pattern of an uncut susceptor. This was used as a control for the experiment. FIG. 23 is an image taken with an infrared camera showing the nearing pattern of the susceptor 62 constructed in accordance with FIG. 21. Intense heating of the center region 64 is apparent. The strips 65, which are connected without disruption to the center region 64, appear to enhance heating of the center region 64.

Figure 25:
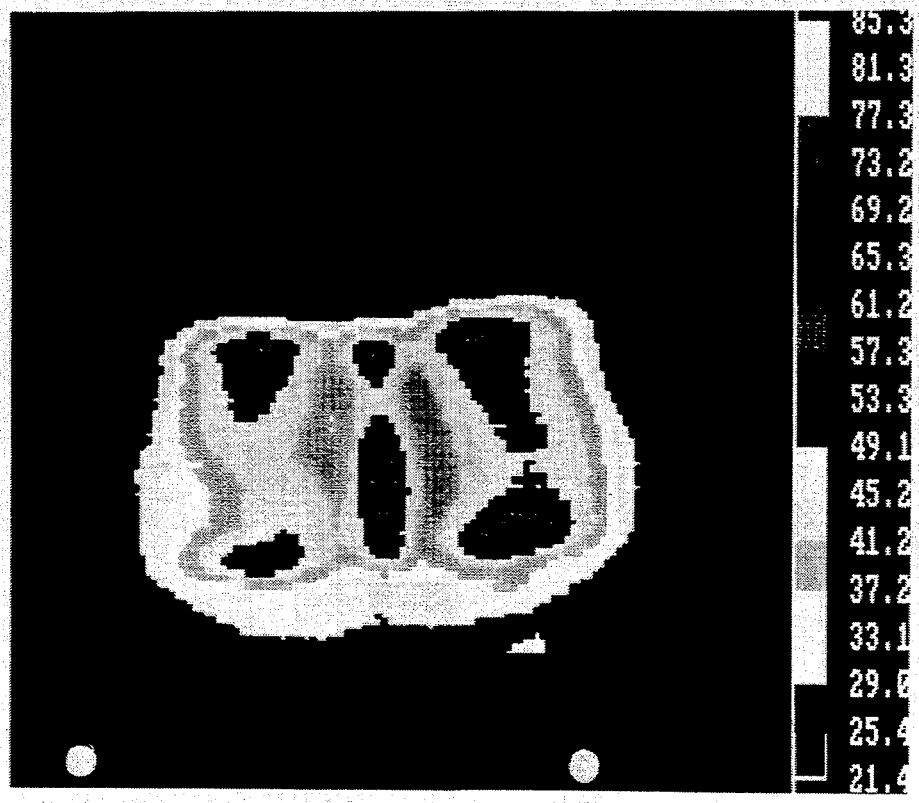
FIG. 25 is an infrared image depicting microwave heating of the susceptor constructed in accordance with FIG. 24.
Figure 24:
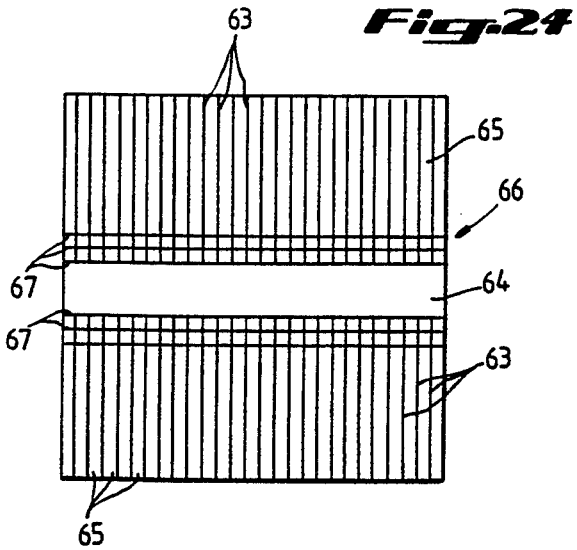
FIG. 24 is a top view of a susceptor constructed in accordance with FIG. 21, and subsequently modified with additional cuts to disrupt electrical conductivity between the center region and the strips of susceptor.

FIG. 24 shows a susceptor pad 66 constructed in accordance with FIG. 21, with the exception that additional cuts 67 were made to disrupt or break the continuity between the strips 65 and the center region 64. FIG. 25 is an image taken with an infrared camera showing the heating pattern of the susceptor pad 66 constructed in accordance with FIG. 24. The heating of the center region 64 is not as pronounced as in the example shown in FIG. 21.

Figure 26:
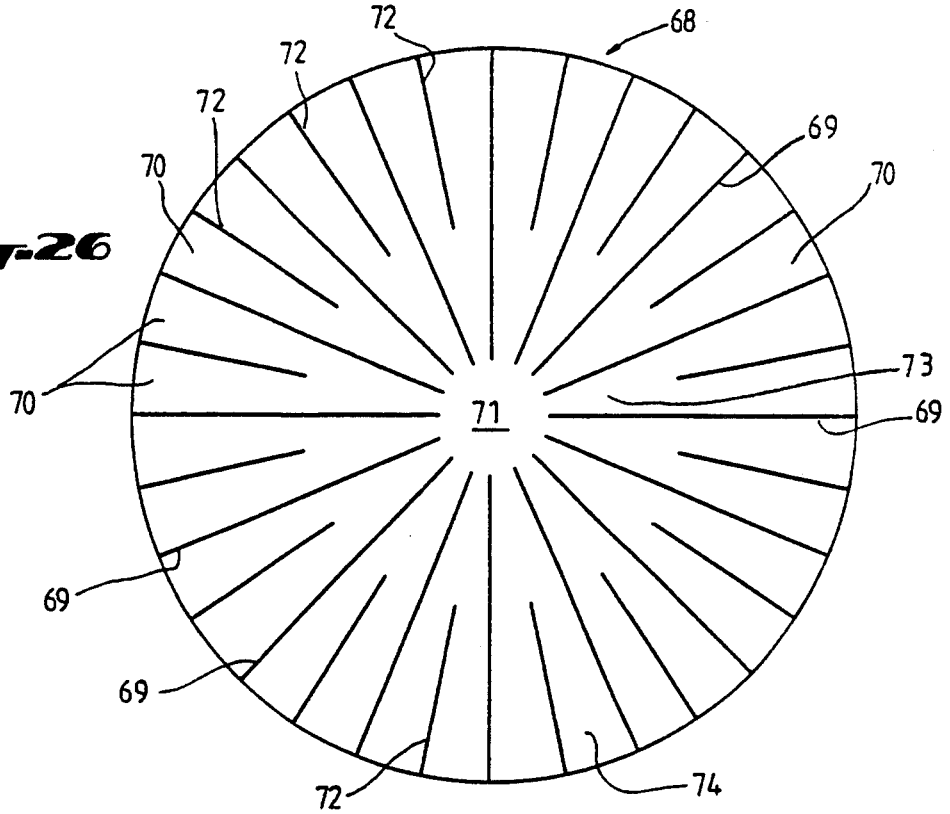
FIG. 26 is a top view of an example of a susceptor utilizing the principle of "directed flow."

FIG. 26 illustrates an alternative embodiment of a susceptor pad 68 utilizing the principle of "directed flow." In this example, the susceptor pad 68 was a circular susceptor, for example, suitable for use with pizza and the like. The susceptor pad 68 illustrated in FIG. 26 has radial cuts or disruptions 69. The cuts 69 define strips 70 extending radially inwardly toward a center region or target area 71. The strips 70 are connected without disruption to the center region 7i. It will be appreciated that the target area 71 may be located at a position other than the center of the susceptor 68.

Secondary cuts 72 may be provided to extend only partially toward the center region 71. A secondary region 73 is defined by the region extending radially outward from the center of the pad 68 to the ends of the secondary cuts 72. This results in a relatively hot center region 71. The secondary region 73 will be generally warmer than the outermost region 74 of the susceptor pad 68.

Generally, the more cuts 69 which are provided in the susceptor pad 68, the hotter the center region 71 will be. It has also been observed in practice that the uniformity of the heating of the outermost region 74 of the susceptor pad 68 is improved by providing an increased number of cuts 69 in the susceptor pad 68.

A circular cut could be made around the center region 71 to break electrical conductivity between the center region 71 and the strips 70. The center region 71, in such an example, has been observed to get preferentially hot during microwave heating, but not as hot as compared to an example where the center region 71 is connected to the strips 70 without disruption, as shown in FIG. 26.

Figure 29:
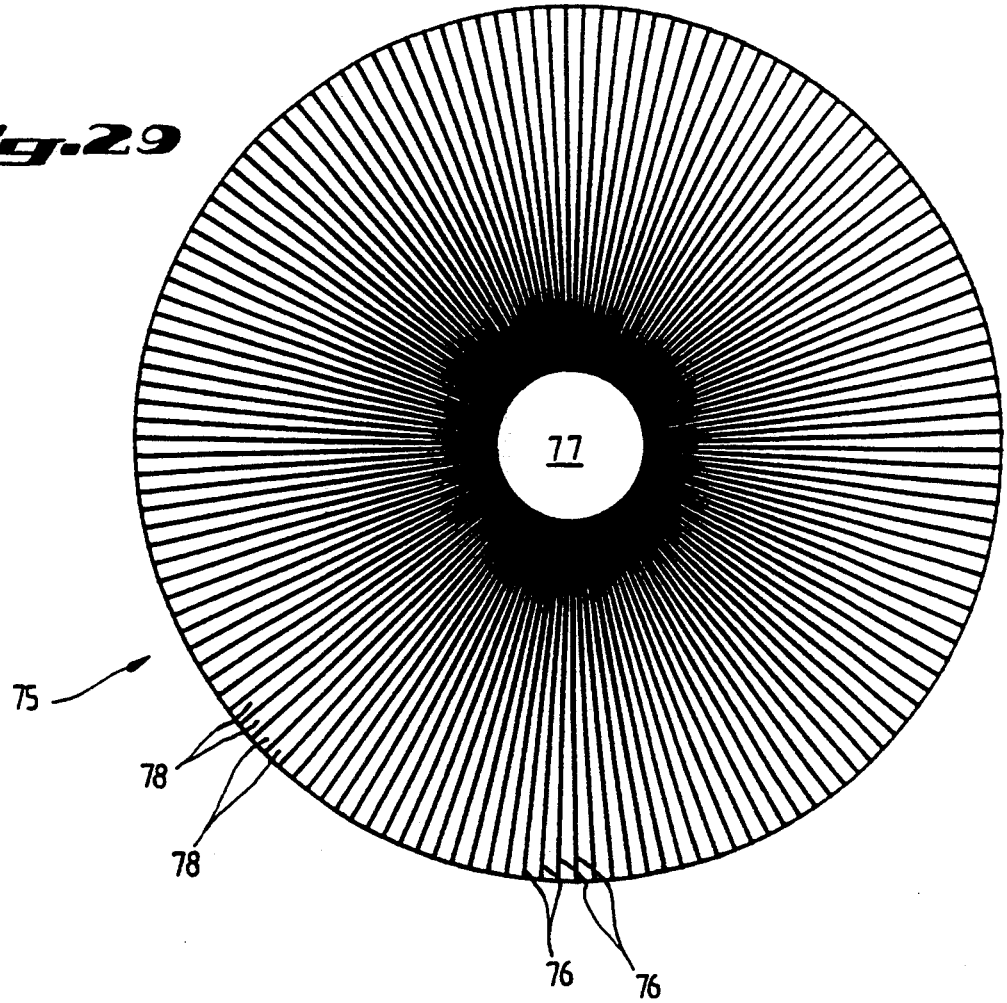
FIG. 29 is a top view of an alternative embodiment of round susceptor using "directed flow."

An alternative embodiment of a round susceptor 75 is shown in FIG. 29. The illustrated example has a plurality of cuts 76 extending from the outer perimeter radially inwardly toward a center region 77. The cuts 76 define a plurality of strips 78 extending radially from the center region 77. In this case, all of the cuts 76 extend from the perimeter of the susceptor 75 to the edge of the center region 77. All other things being equal, the center region 77 of the example illustrated in FIG. 29 would get hotter than the center region 71 of the example illustrated in FIG. 26.

Figure 27:
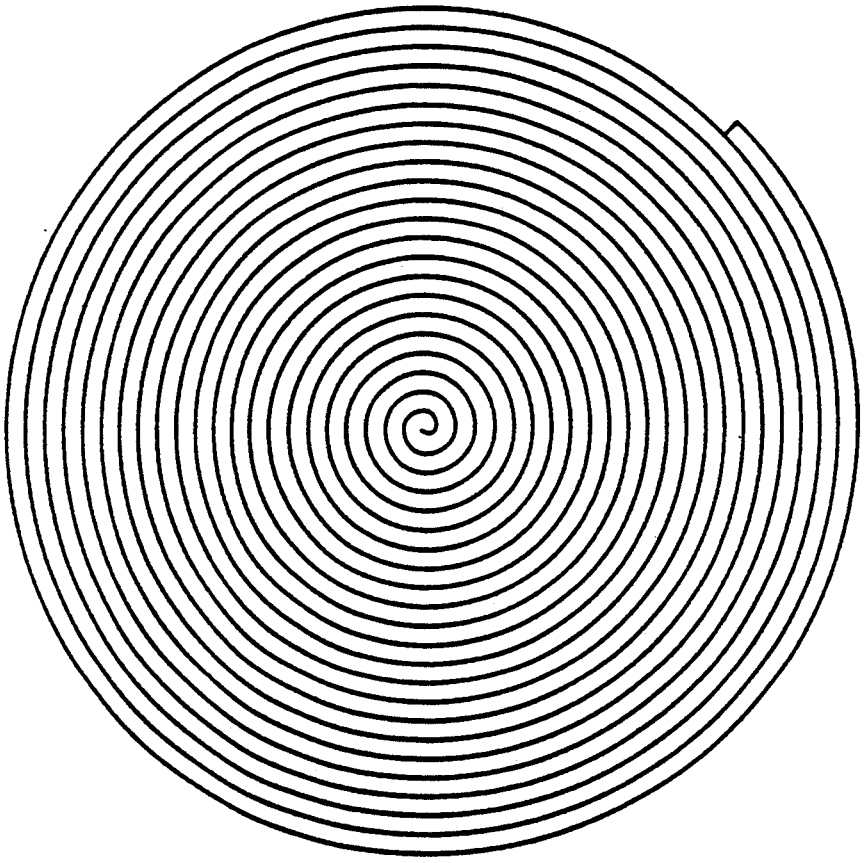
FIG. 27 is a top view of a susceptor constructed in accordance with the present invention having a spiral cut therein to achieve "directed flow."
Figure 28:
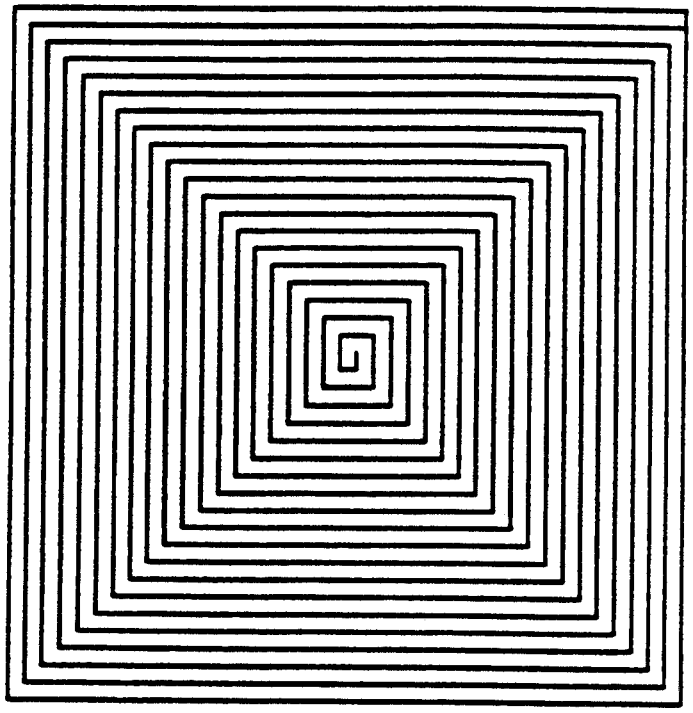
FIG. 28 is a top view of a susceptor constructed in accordance with the present invention having a square spiral cut in order to achieve "directed flow."

A variety of geometries have been used to demonstrate the principle of "directed flow." For example, round spirals, as shown in FIG. 27, squared spirals, as shown in FIG. 28, pinwheel-shaped cuts, cross-shaped regions, etc. have been tried. All of these various geometries demonstrate the ability to generate a relatively hot center region which is connected without disruption to various shaped strips.

The center region generally has been observed to have a maximum size at which the principle of "directed flow" will work most effectively. If the area of the center region is made too large, the center region will not get as hot. The maximum size of the center region is believed to be a function of the resistivity of the susceptor pad material. The lower the resistivity, the larger the center region may be and still effectively result in pronounced heating of the center region. Generally speaking, the smaller the center region the hotter or more intense will be the heating effect on the center region.

A susceptor may be constructed where the susceptor surface is initially constructed having disruptions or breaks in the conductive layer. Additional disclosure is contained in an application entitled "Microwave Heater and Method of Manufacture", by Turpin et al., filed contemporaneously herewith, the entire disclosure of which is incorporated herein by reference.

In the above description, measurements of resistivity, reflectance, transmission, absorbance, etc., were all taken at room temperature (21° C.) unless otherwise specified.

In the above descriptions, measurements taken with a network analyzer all involved the procedure described below. A Hewlett Packard Model No. 8753A network analyzer in combination with a Hewlett Packard Model No. 85046A Sparameter test set were used. All measurements were made at the microwave oven operating frequency of 2.45 GHz. All measurements were made at room temperature, unless otherwise specified. All measurements are made using WR-282 waveguide. Measurements of reflectance, transmission and absorption were made without the presence of a food item.

Measurements are preferably made by placing a sample to be measured between two adjoining pieces of waveguide. Conductive silver paint is preferably placed around the outer edges of a sample sheet which is cut slightly larger than the cross-sectional opening of the waveguide. Colloidal silver paint made by Ted Pella, Inc. has given satisfactory results in practice. The sample is preferably cut so that it has an overlap of about 50/1000 inch (0.127 cm) around the edge. The waveguide is calibrated according to procedures specified and published by Hewlett Packard, the manufacturer of the network analyzer.

Scattering parameters, $S_{11}$, $S_{12}$, $S_{21}$ and $S_{22}$, are measured directly by the network analyzer. These measured parameters are then used to calculate the microwave power reflectance, power transmittance, and power absorbance.

The reflectance looking into port 1 is the magnitude of $S_{11}$ squared. The reflectance into port 2 is the magnitude of $S_{22}$ squared. The transmittance looking into port 1 is the magnitude of $S_{21}$ squared. The transmittance looking into port 2 is the magnitude of $S_{12}$ squared. The power absorbance, looking into either port 1 or port 2, is equal to one minus the sum of the power reflectance and the power transmittance into that port.

The complex surface impedance of an electrically thin sheet is obtained from the measured scattering parameters using formulas presented in "Properties of Thin Metal Films at Microwave Frequencies", by R. L. Ramey and T. S. Lewis, published in the Journal of Applied Physics, Vol. 39, No. 1, pp. 3883–84 (July 1968), along with the information in J. Altman, *Microwave Circuits*, pp. 370–71 (1964), both of which are incorporated herein by reference. For undisrupted susceptor material, the impedance is essentially all resistive. Disruptions or conductivity breaks introduce a capacitance reactance component into the impedance.

The infrared images and temperature measurements made with an infrared camera were taken using a Thermovision 870 scanner (infrared camera). The infrared camera was used in conjunction with a TIC-8000 Thermal Image Computer. Image analysis was accomplished using CATS software, (version 1.04). The infrared camera, computer and software are commercially available from Agema Infrared Systems A.B., with offices in Danderyd, Sweden.

The original infrared images of FIGS. 5, 6, 11, 17, 18, 22, 23 and 25 were in color. For convenience, black and white copies have been used herein. The color originals are not believed to be essential matter. However, the color originals are hereby incorporated herein by reference.

The above disclosure has been directed to a preferred embodiment of the present invention. The invention may be embodied in a number of alternative embodiments other than those illustrated and described above. A person skilled in the art will be able to conceive of a number of modifications to the above described embodiments after having the benefit of the adore disclosure and having the benefit of the teachings herein. The full scope of the invention shall be determined by a proper interpretation of the claims, and shall not be unnecessarily limited to the specific embodiments described above.

What is claimed is:

1. A microwave heatable sheet for cooking food stuff comprising:

(a) a base layer;

(b) a microwave receptor material layer which is attached to and extends over an area of said base layer and which heats up in the presence of microwave energy, said microwave receptor material layer having at least one selected mechanically embossed region in said area which is formed into small pieces to reduce the heating characteristic such that the base layer remains structurally intact, said at least one selected region defining a subarea less than said area and having a different heating characteristic in comparison with the remainder of said area.

2. A package for holding products to be cooked by microwave cooking, said package being formed from a microwave heatable sheet for cooking food stuff comprising:

(a) a base layer;

(b) a microwave receptor material layer which is attached to and extends over an area of said base layer and which heats up in the presence of microwave energy, said microwave receptor material layer having at least one selected mechanically embossed region in said area which is formed into small pieces to reduce the heating characteristic such that the base layer remains structurally intact, said at least one selected region defining a subarea less than said area and having a different heating characteristic in comparison with the remainder of said area.

* * * * *

UNITED STATES PATENT AND TRADEMARK OFFICE

CERTIFICATE OF CORRECTION

PATENT NO. : 5,350,904

DATED : September 27, 1994

INVENTOR(S) : Jonathan D. Kemske, et. al.

It is certified that error appears in the above-indentified patent and that said Letters Patent is hereby corrected as shown below:

Column 1, line 22, delete "wise"; line 29, "neat" should be -- heat --.

Column 2, line 14, "proceeds" should be -- process --; line 50, "The" should be -- the --; line 58, "it" should be -- It --.

Column 3, line 46, "cop" should be -- top --.

Column 5, line 39, "Least" should be -- least --; line 41, "it" should be -- It --.

Column 8, line 66, "she" should be -- the --.

Column 9, line 15, after "region 26" insert -- was --; line 67, "it" should be -- It --.

Column 12, line 67, "near-" should be -- heat- --.

Column 13, line 22, "7i" should be -- 71 --.

Column 14, line 20, "Sparameter" should be -- S-parameter --.

UNITED STATES PATENT AND TRADEMARK OFFICE

CERTIFICATE OF CORRECTION

PATENT NO. : 5,350,904
DATED : September 27, 1994
INVENTOR(S) : Jonathan D. Kemske, et. al.

It is certified that error appears in the above-indentified patent and that said Letters Patent is hereby corrected as shown below:

Column 15, line 22, "adore" should be -- above.

Signed and Sealed this

Thirteenth Day of December, 1994

*Attest:*

Bruce Lehman

BRUCE LEHMAN

*Attesting Officer*

*Commissioner of Patents and Trademarks*